US006723481B2

(12) United States Patent
Lambert et al.

(10) Patent No.: US 6,723,481 B2
(45) **Date of Patent: *Apr. 20, 2004**

(54) METHOD FOR USING HARD MAGNETIC CARRIERS IN AN ELECTROGRAPHIC PROCESS

(75) Inventors: Patrick Lambert, Rochester, NY (US); Eric C. Stelter, Pittsford, NY (US); William K. Goebel, Rochester, NY (US); Peter S. Alexandrovich, Rochester, NY (US)

(73) Assignees: Heidelberger Druckmaschinen AG, Heidelberg (DE); NexPress Solutions LLC, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/853,410

(22) Filed: May 11, 2001

(65) Prior Publication Data

US 2002/0025487 A1 Feb. 28, 2002

Related U.S. Application Data

(60) Provisional application No. 60/204,941, filed on May 17, 2000.

(51) Int. Cl.[7] ..... G03G 13/09

(52) U.S. Cl. ..... 430/122; 430/111.31; 430/111.32; 430/111.33

(58) Field of Search ..... 430/122, 111.41, 430/111.3, 111.31, 111.32, 111.33

(56) References Cited

U.S. PATENT DOCUMENTS

| | | | | |
|---|---|---|---|---|
| 3,716,630 A | | 2/1973 | Shirk | 423/594 |
| 3,795,617 A | | 3/1974 | McCabe | 252/62.1 |
| 3,795,618 A | | 3/1974 | Kasper | 252/62.1 |
| 3,893,935 A | | 7/1975 | Jadwin et al. | 252/62.1 |
| 3,938,992 A | | 2/1976 | Jadwin et al. | |
| 3,941,898 A | | 3/1976 | Sadamatsu et al. | 427/18 |
| 4,042,518 A | | 8/1977 | Jones | 252/62.6 |
| 4,076,857 A | | 2/1978 | Kasper et al. | 427/18 |
| 4,206,064 A | | 6/1980 | Kiuchi et al. | |
| 4,385,823 A | | 5/1983 | Kasper et al. | 355/3 R |
| 4,394,429 A | | 7/1983 | Hays | |
| 4,473,029 A | | 9/1984 | Fritz et al. | 118/657 |
| 4,496,643 A | | 1/1985 | Wilson et al. | |
| 4,531,832 A | | 7/1985 | Kroll et al. | 355/3 DD |
| 4,546,060 A | | 10/1985 | Miskinis et al. | |
| 4,623,603 A | | 11/1986 | Iimura et al. | |
| 4,764,445 A | | 8/1988 | Miskinis et al. | |
| 4,786,430 A | | 11/1988 | Mair | |
| 4,833,060 A | | 5/1989 | Nair et al. | |
| 4,855,205 A | | 8/1989 | Saha et al. | |
| 4,855,206 A | | 8/1989 | Saha | |
| 4,925,762 A | | 5/1990 | Ostertag et al. | |
| 5,061,586 A | | 10/1991 | Saha et al. | |
| 5,104,761 A | | 4/1992 | Saha et al. | |
| 5,106,714 A | | 4/1992 | Saha et al. | |
| 5,190,841 A | | 3/1993 | Saha et al. | |
| 5,190,842 A | | 3/1993 | Saha et al. | |
| 5,212,038 A | | 5/1993 | Watanabe et al. | 430/122 |
| 5,256,513 A | | 10/1993 | Kawamura et al. | |
| 5,268,249 A | | 12/1993 | Saha et al. | |
| 5,306,592 A | | 4/1994 | Saha | |
| 5,318,873 A | | 6/1994 | Kawamura et al. | 430/122 |
| 5,332,645 A | | 7/1994 | Saha et al. | |
| 5,376,492 A | | 12/1994 | Stelter et al. | 430/122 |
| 5,424,160 A | | 6/1995 | Smith et al. | |
| 5,496,674 A | | 3/1996 | Adel et al. | |
| 5,500,320 A | | 3/1996 | Saha | |
| 5,512,403 A | | 4/1996 | Tyagi et al. | |
| 5,512,404 A | | 4/1996 | Saha | |
| 5,532,096 A | | 7/1996 | Maruta et al. | |
| 5,534,378 A | | 7/1996 | Adel et al. | |
| 5,561,018 A | | 10/1996 | Moriya | |
| 5,614,346 A | * | 3/1997 | Adel et al. | 430/111.3 |
| 5,705,221 A | | 1/1998 | Yoerger | 427/214 |
| 5,710,965 A | | 1/1998 | Nozawa et al. | 399/313 |
| 5,737,677 A | | 4/1998 | Tombs et al. | 399/296 |
| 5,795,692 A | | 8/1998 | Lewis | |
| 5,948,585 A | | 9/1999 | Gady et al. | |
| 5,989,767 A | | 11/1999 | Yoerger et al. | |
| 5,998,076 A | | 12/1999 | Mahabadi et al. | |
| 6,040,103 A | | 3/2000 | Ohno et al. | |
| 6,228,549 B1 | * | 5/2001 | Lambert et al. | 430/111.41 |
| 6,232,026 B1 | * | 5/2001 | Lambert | 430/111.41 |

FOREIGN PATENT DOCUMENTS

| | | | |
|---|---|---|---|
| EP | 0 003 905 A1 | 9/1979 | C08J/3/02 |
| EP | 0 086 445 A1 | 8/1983 | H01F/1/36 |

(List continued on next page.)

OTHER PUBLICATIONS

"Magnetic Materials", B. D. Cullity, published by Addison–Wesley Pub. Co. 1972, p. 18–23.

"Spray Drying", by K. Masters, published by Leonard Hill Brooks, London, p. 502–509.

(List continued on next page.)

*Primary Examiner*—Janis L. Dote

(57) ABSTRACT

Methods for development of an electrostatic image are disclosed that utilize developer compositions with hard magnetic carrier compositions which can provide improved development efficiencies and reduced amounts of image carrier pick-up. The methods utilize hard magnetic carrier particles that are modified to have specific levels of resistivity, such as, for example, of from about $1\times10^5$ ohm-cm to about $1\times10^{10}$ ohm-cm, and a carrier charge-to-mass of greater than about 1.0 $\mu$C/g, which carriers can provide greater development speeds without unacceptable levels of image carrier pick-up. In embodiments, the hard magnetic materials are doped, i.e., bulk substituted, with multi-valent metals to adjust resistivity, while in other embodiments, the hard magnetic materials are coated with at least one multi-valent metal oxide.

24 Claims, 9 Drawing Sheets

FOREIGN PATENT DOCUMENTS

| | | | | |
|---|---|---|---|---|
| EP | 0 091 654 A | | 10/1983 | |
| EP | 0 296 072 A | | 12/1988 | |
| EP | 0 303 918 A | | 2/1989 | |
| EP | 0 353 630 A | | 2/1990 | |
| EP | 0353630 | | 2/1990 | |
| EP | 0452209 | | 10/1991 | |
| EP | 0547620 | | 12/1991 | |
| EP | 0 509 790 A | | 10/1992 | |
| EP | 0519396 A1 | * | 12/1992 | ..... 430/111.31 |
| EP | 0580135 | | 7/1993 | |
| EP | 0668542 | | 1/1995 | |
| EP | 0 674 238 A | | 9/1995 | |
| EP | 0 708 379 A | | 4/1996 | |
| GB | 1 501 065 | | 2/1978 | ..... G03G/9/08 |
| WO | WO 93/12470 | | 6/1993 | |
| WO | WO 91/15811 | | 10/1995 | |

OTHER PUBLICATIONS

"Ferromagnetic Materials", vol. 3, edited by E. P. Wohlfarth, published by North–Halland Pat. Co. Amsterdam p. 305 et seq.

Research Disclosure No. 21030, vol. 210, Oct. 1981 (published by Industrial opportunities Ltd., Homewell, Havant, Hampshire, P09 1EF, United Kingdom).

U.S. Patent Application Ser. No. 09/572,988 filed May 17, 2000.

U.S. Patent Application Ser. No. 09/572,989 filed May 17, 2000.

U.S. Provisional patent application Ser. No. 60/204,941 filed May 17, 2000.

PCT International Search Report for Application No. PCT/US01/15421.

European Search Report forApplication No. EP 01 11 0143.

PCT International Search Report for Application No. PCT/US01/15509.

European Search Report for Application No. EP 01 11 0141.

PCT International Search Report for Application No. PCT/US01/15510.

European Search Report for Application No. EP 01 11 1258.

European Search Report 01110143.3.

Eoropean Search Report 01111258.8.

WPI Derwent XP–002202057, pub 1998, describing JP 10–171157.

* cited by examiner

METHOD FOR USING HARD MAGNETIC CARRIERS IN AN ELECTROGRAPHIC PROCESS

CROSS REFERENCE TO RELATED APPLICATIONS

This application claims benefit under 35 USC §119(e) of prior co-pending U.S. Provisional Patent Application Ser. No. 60/204,941, filed May 17, 2000, the disclosure of which is incorporated herein by reference in its entirety. Attention is also directed to the following related U.S. patent applications: U.S. Ser. No. 09/572,988, now U.S. Pat. No. 6,232,026, entitled "MAGNETIC CARRIER PARTICLES"; and U.S. Ser. No. 09/572,989, now U.S. Pat. No. 6,228,549, entitled "MAGNETIC CARRIER PARTICLES", both filed on May 17, 2000, the disclosures of which are also incorporated herein by reference in their entirety.

BACKGROUND OF THE INVENTION

This invention relates to electrography and more particularly it relates to magnetic carrier particles and developers used for the dry development of electrostatic charge images.

In electrography, an electrostatic charge image is formed on a dielectric surface, typically the surface of the photoconductive recording element. Development of this image is typically achieved by contacting it with a two-component developer comprising a mixture of pigmented resinous particles, known as toner, and magnetically attractable particles, known as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is generally known to apply developer compositions of the above type to electrostatic images by means of a magnetic applicator, also known as a magnetic brush, which comprises a cylindrical sleeve of non-magnetic material having a magnetic core positioned therein. The core usually comprises a plurality of parallel magnetic strips arranged around the core surface to present alternating north and south oriented magnetic fields. These fields project radially, through the sleeve, and serve to attract the developer composition to the sleeve outer surface to form what is commonly referred to in the art as a "brush" or "nap". Either or both the cylindrical sleeve and the magnetic core are rotated with respect to each other to cause the developer to advance from a supply sump to a position in which it contacts the electrostatic image to be developed. After development, the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060, 4,473,029 and 5,376,492, the teachings of which are incorporated herein by reference in their entirety, teach use of hard magnetic materials as carrier particles and also apparatus for development of electrostatic images utilizing such hard magnetic carrier particles. These patents require that the carrier particles comprise a hard magnetic material exhibiting a coercivity of at least 300 Oersteds when magnetically saturated and an induced magnetic moment of at least 20 EMU/gm when in an applied magnetic field of 1000 Oersteds. The terms "hard" and "soft" when referring to magnetic materials have the generally accepted meaning as indicated on page 18 of Introduction To Magnetic Materials by B. D. Cullity published by Addison-Wesley Publishing Company, 1972. These hard magnetic carrier materials represent a great advance over the use of soft magnetic carrier materials in that the speed of development is remarkably increased with good image development. Speeds as high as four times the maximum speed utilized in the use of soft magnetic carrier particles have been demonstrated.

In the methods taught by the foregoing patents, the developer is moved in the same direction as the electrostatic image to be developed by high-speed rotation of the multipole magnetic core within the sleeve, with the developer being disposed on the outer surface of the sleeve. Rapid pole transitions on the sleeve are mechanically resisted by the carrier because of its high coercivity. The nap, also called "strings" or "chains", of carrier (with toner particles disposed on the surface of the carrier particles), rapidly "flips" on the sleeve in order to align with the magnetic field reversals imposed by the rotating magnetic core, and as a result, moves with the toner on the sleeve through the development zone in contact with or close relation to the electrostatic image on a photoconductor. This interaction of the developer with the charge image is referred to as "contact" or "contacting" herein for purposes of convenience. See also, U.S. Pat. No. 4,531,832, the teachings of which are also incorporated herein in their entirety, for further discussion concerning such a process.

The rapid pole transitions, for example as many as 467 per second at the sleeve surface when the magnetic core is rotated at a speed of 2000 revolutions per minute (rpm), create a highly energetic and vigorous movement of developer as it moves through the development zone. This vigorous action constantly recirculates the toner to the sleeve surface and then back to the outside of the nap to provide toner for development. This flipping action thus results in a continuous feed of fresh toner particles to the image. As described in the above-described patents, this method provides high density, high quality images at relatively high development speeds.

The above-mentioned U.S. patents, while generic to all hard magnetic materials having the properties set forth therein, prefer the hard magnetic ferrites which are compounds of barium and/or strontium, such as, $BaFe_{12}O_{19}$, $SrFe_{12}O_{19}$ and the magnetic ferrites having the formula $MO.6Fe_2O_3$, where M is barium, strontium or lead as disclosed in U.S. Pat. No. 3,716,630. While these hard ferrite carrier materials represent a substantial increase in the speed with which development can be conducted in an electrostatographic apparatus, many users of such equipment seek even faster development speeds and so further improvements to the carrier and development process are of interest.

U.S. Pat. No. 4,764,445 discloses hard magnetic ferrite carrier particles for electrographic developing applications which contain from about 1 to about 5 percent by weight of lanthanum. As mentioned in this patent, the speed of development in an electrographic process using conventional hard magnetic ferrite materials, while higher than methods using other techniques, such as with soft magnetic carriers, is limited by the resistivity of such ferrite materials. The patent discloses that addition of lanthanum to the hard magnetic ferrite crystal structure in the disclosed amounts results in a more conductive magnetic ferrite particle, yielding greater development efficiency and/or speed of development.

Others have also proposed methods for making conductive carrier particles. For example, U.S. Pat. No. 4,855,206 discloses adding neodymium, praseodymium, samarium, europium, or mixtures thereof, or a mixture of one or more of such elements and lanthanum, to a hard magnetic ferrite material to increase conductivity. U.S. Pat. No. 5,795,692 discloses a conductive carrier composition having a magnetic oxide core which is said to be coated with a layer of zinc metal that is the reaction product of zinc vapor and the magnetic oxide.

Other carriers proposed for use in an electrographic process include multi-phase ferrite composites as taught in U.S. Pat. Nos. 4,855,205; 5,061,586; 5,104,761; 5,106,714; 5,190,841; and 5,190,842.

U.S. Pat. No. 5,268,249 discloses magnetic carrier particles with a single-phase, W-type hexagonal crystal structure of the formula $MFe_{16}Me_2O_{27}$ where M is strontium or barium and Me is a divalent transition metal selected from nickel, cobalt, copper, zinc, manganese, magnesium, or iron.

U.S. Pat. No. 5,532,096 discloses a carrier which has been coated on the surface thereof with a layer obtained by curing a partially hydrolyzed sol obtained from at least one alkoxide selected from the group consisting of silicon alkoxides, titanium alkoxides, aluminum alkoxides, and zirconium alkoxides. The disclosed carriers coated with such layer are said to be more durable in comparison to carriers coated with conventional resin coatings, such as those prepared using silicone, acrylic and styrene-acrylic resins.

While some of the above-described patent art may describe carriers with increased conductivity relative to traditional hard magnetic ferrite materials previously employed in development of electrostatic images, the conductivity of the carriers is believed to be so great that imaging problems are typically created due to the carrier being deposited in the image. Although not clear, it is believed that certain levels of conductivity in the carrier can facilitate a flow of charge between the carrier on the nap and the shell, thereby inducing a charge reversal on the carrier and allowing the carrier particles to electrostatically deposit on the image, referred to hereinafter as "image carrier pick-up" or "I-CPU". The presence of I-CPU can impact color rendition and image quality.

As can be seen, it would be desirable to develop new carriers and/or new methods for use of carriers that can be used in an electrographic process for the development of latent electrostatic images. It would also be desirable to develop carriers that can exhibit a greater level of conductivity relative to traditional hard magnetic materials previously employed in such processes, which can provide electrographic methods having higher levels of development efficiency with reduced levels of I-CPU.

SUMMARY OF THE INVENTION

The foregoing objects and advantages are realized by the present invention, which, in one aspect, concerns a method for development of an electrostatic image comprising contacting the image with a development system including at least one magnetic brush comprising:

(a) a rotating magnetic core of a pre-selected magnetic field strength, (b) an outer nonmagnetic shell disposed about the rotating magnetic core, and (c) an electrographic developer composition comprising (i) charged toner particles, and (ii) oppositely charged hard magnetic carrier particles with a resistivity of from about $1\times10^{10}$ ohm-cm to about $1\times10^{5}$ ohm-cm and a $(Q/m)_{carrier}$ of greater than about 1 $\mu$C/g, the developer composition being disposed on the shell and in contact with the image, the method resulting in a carrier deposition density on the image of less than about 0.01 g/in$^2$.

In another aspect, the invention concerns a method for development of an electrostatic image comprising contacting the image with at least one magnetic brush comprising (a) a rotating magnetic core of a pre-selected magnetic field strength, (b) an outer nonmagnetic shell disposed about the rotating core, and (c) an electrographic developer composition disposed on the shell and in contact with the image. The developer composition comprises charged toner particles and oppositely charged carrier particles, the carrier particles comprising a hard magnetic material having a crystal structure substituted with at least one multi-valent metal of the formula $M^{n+}$, wherein n is an integer of at least 4. Preferably, the at least one multi-valent metal is selected from the group consisting of antimony, arsenic, germanium, hafnium, molybdenum, niobium, silicon, tantalum, tellurium, tin, titanium, tungsten, vanadium, zirconium, and mixtures thereof. As a matter of particular presence, the at least one multi-valent metal is selected from the group consisting of silicon, zirconium, tin, titanium, and mixtures thereof.

In a preferred embodiment, the carrier particles comprise a hard magnetic ferrite material having a single-phase hexagonal crystal structure and represented by the formula:

$$PFe_{12-}M_xO_{19}$$

wherein:

P is selected from strontium, barium, or lead;

M is at least one metal selected from antimony, arsenic, germanium, hafnium, molybdenum, niobium, silicon, tantalum, tellurium, tin, titanium, tungsten, vanadium, zirconium, and mixtures thereof; and x is less than about 0.6.

In another aspect, the invention concerns a method for development of an electrostatic image comprising contacting the image with at least one magnetic brush comprising (a) a rotating magnetic core of a pre-selected magnetic field strength, (b) an outer nonmagnetic shell disposed about the rotating core, and (c) an electrographic developer composition disposed on the shell and in contact with the image, the developer composition comprising charged toner particles and oppositely charged carrier particles. The carrier particles comprise (1) a core of a hard magnetic material having an outer surface and (2) a metal oxide composition disposed on the outer surface of the core represented by the formula $MO_{n/2}$ wherein M is at least one multi-valent metal represented by $M^{n+}$, with n being an integer of at least 4. The outer surface further defines a transition zone which extends from the outer surface and into the core of the hard magnetic material where the hard magnetic material has a crystal structure within the transition zone substituted with ions of the at least one multi-valent metal ion of formula $M^{n+}$ as previously described.

In another aspect, the invention relates to a method for development of an electrostatic image comprising contacting the image with at least one magnetic brush comprising (a) a rotating magnetic core of a pre-selected magnetic field strength, (b) an outer nonmagnetic shell disposed about the rotating core, and (c) an electrographic developer composition disposed on the shell and in contact with the image, the developer composition comprising charged toner particles and oppositely charged carrier particles. The carrier particles comprise a hard magnetic ferrite material having a single-phase hexagonal crystal structure represented by the formula:

$$P_{1-y}La_yFe_{12}O_{19}$$

wherein:

P is selected from strontium, barium, or lead; and y is less than 0.1.

Also disclosed are carrier particles for use in the development of electrostatic latent images, which carriers comprise the hard magnetic ferrite material substituted with lanthanum as described in the preceding paragraph.

DETAILED DESCRIPTION OF THE INVENTION

Figure 1:
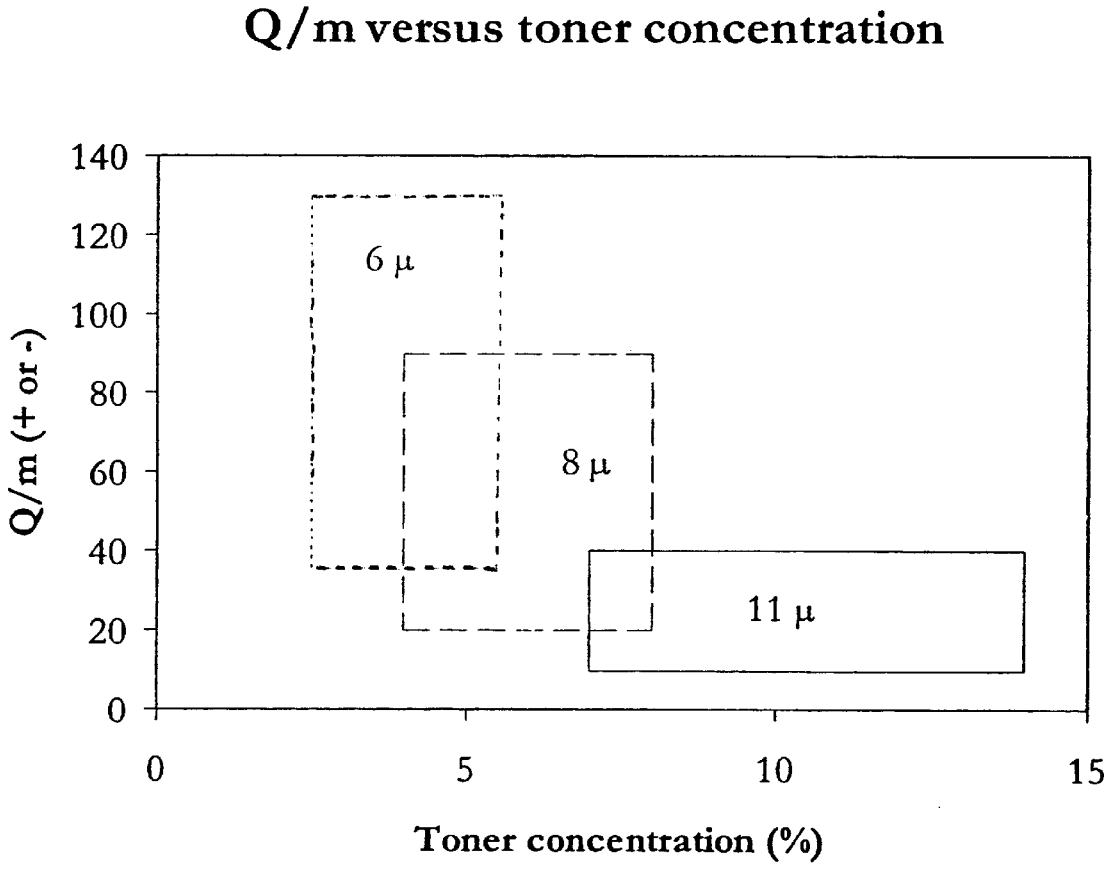
FIG. 1 is a graph of toner charge-to-mass (Q/m) versus toner concentration for a developer used in a method according to the present invention, the figure showing operating windows for three different toner particle sizes and illustrating an operating region for each which can yield desirable electrographic system performance.

As previously pointed out in connection with U.S. Pat. Nos. 4,546,060 and 4,473,029, the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO.6Fe_2O_3$ wherein M is barium, strontium or lead. A preferred ferrite is strontium ferrite. These materials have a single-phase, hexagonal crystal structure. While the speed with which development can be carried out is much higher than prior techniques, they are limited by the resistivity of the above described ferrite materials which have the necessary magnetic properties for carrying out the development method. It is generally known that the resistivity of the carrier particles bears a direct result on the speed of development that can be employed.

While development speed is generally referred to in the art, a more meaningful term is to speak of "development efficiency". In a magnetic brush development system, development efficiency in percent is defined as the potential difference between the photoreceptor in developed image areas before and after development divided by the potential difference between the photoreceptor and the brush prior to development times 100. For example, in a charged area development configuration, if the photoreceptor film voltage is −250 volts and the magnetic brush is −50 volts, the potential difference is −200 volts prior to development. If, during development, the film voltage is reduced by 100 volts to −150 volts in image areas by the deposition of positively charged toner particles, the development efficiency is (−100 volts divided by −200 volts) times 100, which gives an efficiency of development of 50 percent. It can be readily seen that as the efficiency of the developer material increases the various parameters employed in the electrostatographic method can be altered in accordance therewith. For example, as the efficiency increases the voltage differential prior to development can be reduced in order to deposit the same amount of toner in image areas as was previously done at the lower efficiency. The same is true with regard to the exposure energy level employed to impart the latent electrostatic image on the photoreceptor film. The speed of the development step of the procedure can be increased as the efficiency increases since more toner can be deposited under the same conditions in a shorter period of time. Thus, higher development efficiency permits adjustment of the various parameters employed in the electrostatic process to result in savings in both energy and time.

As previously mentioned the efficiency of development when employing hard magnetic carriers is limited by the resistivity of the materials themselves. For example, because these materials have a resistivity of approximately $1\times10^{11}$ ohm-cm, therefore, the efficiency typically obtained is approximately 50 percent. However, in order to obtain high quality copies of the original image, it is necessary to maintain high magnetic properties; i.e. a coercivity of at least about 300 Oersteds, or of at least about 1000 Oersteds, when magnetically saturated and an induced magnetic moment of at least about 20 EMU/gm when in an applied field of 1000 Oersteds while at the same time increasing the conductivity of the particles.

The electrophotographic printing industry is presently interested in developing equipment with higher speed (pages per minute—ppm) and higher image quality. These two performance goals require materials, i.e., developer compositions, with characteristics that are in contraposition to each other. Higher image quality is associated with smaller toner particle size. Smaller toner size generally connotes reduced development efficiency (DE), and as such, limits machine speed. While adjustment of hardware operating conditions such as core speed, shell speed, gap setting and toning bias provide considerable latitude for high speed/high quality copying/printing, the material characteristics of the carrier component of the developer may also be manipulated.

The realization of increased development efficiency through the application of conductive carriers is limited by the image carrier pickup (I-CPU). This behavior follows from an induced reversal charge on carrier particles in the brush under the influence of the bias and contact with the shell. The carrier particles of reversed polarity are electrostatically attracted to the charge image on the photoconductor; in effect, these particles act as toner and deposit in the image accordingly. Conductive carriers are believed to be more susceptible to this charge reversal, because of the increased charge mobility associated with higher conductivity. The presence of carrier in the image area is not particularly detrimental in black and white text documents; however, it confounds flat black and white images and severely impacts rendition, gamut and density in color documents.

While not wishing to be bound by theory, it is believed that I-CPU depends on carrier charge. In a developer composition comprising carrier particles and toner particles, the carrier charge is opposite in polarity to the toner charge. For conventional, non-conductive carrier, when toner is developed into the image during development, the carrier can be developed into background areas of the image, usually at a highest concentration in areas immediately adjacent to toned image areas where fringe electric fields are strongest. For carriers with higher levels of conductivity, due to the charge mobility mentioned above, electric charge can be conducted into the carrier particles from the toning shell when the developer composition is in the electric field of a "toning nip", i.e., the area between the photoconductive surface (whereon the latent electrostatic image being developed resides) and the surface of the shell sleeve for the toning station (whereon the developer composition resides). For discharged area development (DAD), the bias voltage of the toning station is the same polarity as the toner and the toning bias can therefore charge a conductive carrier to the same polarity as the toner. If the carrier acquires sufficient charge by conduction of such charge from the shell within the toning nip, the carrier can actually develop into image areas on the photoconductor.

A negative-charging toner is considered in the following discussion. Assuming charge neutrality for the toner and carrier particles, when the externally applied electric field (E) is zero, the carrier charge and the toner charge in the developer composition may be related to toner concentration (TC) according to the following Equation (1):

$$Q_T/M_T \times TC + Q_C/M_C \times (1-TC) = 0 \quad (1)$$

wherein $Q_T$ and $Q_C$ represent the charge of the toner and carrier respectively; $M_T$ and $M_C$ represent the mass of the toner or carrier respectively; × signifies multiplication (not a variable); and TC is the fractional toner concentration based on total weight of the composition, or the toner concentration in weight percent, divided by 100. Therefore, the initial carrier charge to mass ratio (in $\mu$C/g) can be stated by the following Equation (2):

$$Q_{Ci}/M_C = -Q_T/M_T \times TC/(1-TC) \quad (2)$$

As the developer composition moves into the electric field of the toning nip area, it is believed that the carrier loses its initial positive charge and becomes more negative in charge by the conductive charge mechanism as previously described. If there is sufficient residence time within the toning nip area, the carrier can acquire a large enough negative charge that it will develop into the image areas with the toner.

Although not bound by theory, it is reasonable to assume that the initial carrier charge is approximated by Equation (2) and the carrier charge in the toning nip area follows an exponential time dependence, as illustrated for example by Equation (3) below:

$$Q_{Ct}/M_C = Q_{Ci}/M_C \times e^{-kt} + Q_{Cf}/M_C \times (1-e^{-kt}) \quad (3)$$

wherein $Q_{Ct}/M_C$ is the carrier charge to mass as a function of time; $Q_{Ci}/M_C$ is the initial carrier charge to mass as described above; the rate constant k is $1/\rho\epsilon$, in units of $sec^{-1}$; × signifies multiplication (not a variable); t is the residence time in the toning nip in seconds; and the maximum final carrier charge is given by $Q_{Cf}/M_C$.

In Equation (3), quantitatively ρ is the resistivity of the developer composition and ϵ is the dielectric constant of the developer composition. The developer resistivity ρ can be measured as described in Examples 43–52 hereinafter. The dielectric constant ϵ is affected by the volume in the developer composition that is occupied by the toner. Increasing the toner particle size will displace carrier particles and correspondingly result in a proportionate decrease in the dielectric constant of the developer composition. Due to this effect, $\epsilon \propto 1/D_T^3$, where $D_T$ is the average particle size (diameter) of the toner particles.

The maximum carrier charge to mass ratio $Q_{Cf}/M_C$ depends on the voltage difference between the electrostatic image on the photoconductive surface and the toning station shell sleeve. For a 400 volt potential difference with "bare carrier" (no toner), $Q_{Cf}/M_C$ can be reasonably assumed to be about −2 $\mu$C/g. If toner is present, the potential difference between the shell sleeve and photoconductive surface at the trailing edge (exit) of the toning nip area is decreased by the charge of toner particles which develop into the image. The fractional development efficiency—DE—can be approximated as the fraction of the initial toning potential difference removed by development of the toner, and equals the development efficiency in percent divided by 100. For a 400 V toning potential, $Q_{Cf}/M_C \propto -2\times(1-DE)$ in terms of $\mu$C/g. This equation states that, if the development efficiency is large, there is less potential to drive charge into the carrier, and the maximum carrier charge to mass ratio is reduced proportionally. Data obtained in connection with Examples 43–52 and Comparative Example E hereinafter is used with the above-described model and confirms that I-CPU depends upon the charge that the carrier acquires in the toning nip area.

The present invention further relates to material and hardware parameters that provide operating spaces for higher development efficiency without increased I-CPU. Improvements in development efficiency can be obtained without a concurrent increase in I-CPU if certain material and hardware operating conditions are met.

A general relationship for such operating spaces in terms of toner charge-to-mass (Q/m) and toner concentration (TC) for different toner particle sizes is shown in FIG. 1. FIG. 1, which is provided for discussion purposes, illustrates that smaller particle size toners tend to operate preferably at lower toner concentrations and exhibit higher toner charge-to-mass. These relationships hold for either polarity toner.

In tabular form, along with the associated change in development efficiency and the implied carrier conductivity to regain development efficiency, the relationships can be described as follows:

| Toner size | Toner Q/m | Development Efficiency | Required Carrier Conductivity |
|---|---|---|---|
| ↓ | ↑ | ↓ | ↑ |

In the table above, the arrows represent an increase or decrease in the associated parameter. To counteract the expected drop in development efficiency by using smaller toner sizes, it is desirable to use a carrier with greater conductivity as indicated by the upward pointing arrow under the heading "Required Carrier Conductivity".

The drive to higher quality and higher speed systems necessitates a decrease in toner particle size from which a decrease in development efficiency follows. To regain development efficiency, the carrier conductivity should be further increased (in other words, the carrier's resistivity should be decreased) as the toner size decreases. To be viable, the enhancement in development rate should occur without noticeable I-CPU.

To address the reduction of I-CPU, the toner size/concentration/charge space as illustrated by FIG. 1 is unwieldy and difficult to generalize over all anticipated operating ranges. For each toner size, a table could be set up with data sets to indicate, for example, using each of the three toner sizes shown in FIG. 1, the resistivity range required to maintain development efficiency along with the preferred range for limited I-CPU. An alternate approach utilized in connection with Examples 43–52 hereinafter, is to characterize the development performance of a developer composition by parameters of primary merit, i.e., the carrier charge-to-mass—$(Q/m)_{carrier}$—(in terms of $\mu$C/g) and developer composition resistivity (in ohm-cm).

Data generally shows that the developers exhibiting the highest I-CPU have the lowest calculated $(Q/m)_{carrier}$ as determined by charge neutrality. For example, as the toner concentration increases, the toner charge decreases by a small percentage, however, the net $(Q/m)_{carrier}$ can double or triple in value. The higher the net $(Q/m)_{carrier}$ the more difficult it is to induce the charge reversal of the carrier leading to I-CPU. As one goes to a smaller toner particle size, the increased toner Q/m can reduce I-CPU, but the lower toner concentration could also induce I-CPU. As a result, it is desirable that $(Q/m)_{carrier}$ be maintained at greater than about 1 $\mu$C/g, preferably greater than about 2 $\mu$C/g, more preferably greater than about 3 $\mu$C/g, and most preferably greater than about 4.0 $\mu$C/g. The $(Q/m)_{carrier}$ parameter can be controlled by adjusting the level of toner in the developer composition, as illustrated for example in Examples 43–52 hereinafter.

As such, the present invention seeks to at least maintain development efficiency as toner size decreases, and therefore conductivity of the carrier should be increased proportionally, while $(Q/m)_{carrier}$ should be kept high, such as a value greater than about 1 $\mu$C/g as previously described. In addition, to obtain high quality copies with minimum amounts of I-CPU, it is preferable to maintain the resistivity of the carrier to a value of from about $1\times10^{10}$ ohm-cm to about $1\times10^{5}$ ohm-cm, more preferably from about $5\times10^{9}$ ohm-cm to about $1\times10^{6}$ ohm-cm, and even more preferably from about $5\times10^{9}$ ohm-cm to about $1\times10^{7}$ ohm-cm. When the carrier resistivity is selected to be within the foregoing range, it will generally result in a developer composition resistivity of desirably from about $1\times10^{12}$ ohm-cm to about $1\times10^{5}$ ohm-cm, preferably $1\times10^{10}$ ohm-cm to $1\times10^{7}$ ohm-cm. The developer resistivity will generally be very similar to the carrier resistivity, since the developer composition is largely carrier.

Electrographic processes can operate at a process speed (which is defined as the speed at which the dielectric surface bearing the charge image thereon is passed through the development zone) of at least about 5 inches/sec, and typically high volume printers can operate at a speed of from about 110 pages per minute (PPM) to 180 PPM and up, which corresponds to a process speed of from about 15 to about 30 inches/sec, and a process speed of from about 15 to about 50 inches/sec would be preferred. Carriers with a resistivity toward the lower part of the foregoing ranges, i.e., a resistivity of less than about $1\times10^{7}$ ohm-cm, i.e., from about $1\times10^{7}$ ohm-cm to about $1\times10^{5}$ ohm-cm, would be particularly advantageous for use in electrographic processes operating at relatively high process speeds. This is due to the fact that a higher process speed results in a proportional decrease in the residence time of carrier within the toning nip area, wherein residence time (in seconds) is defined as the toning nip width (in inches) divided by the process speed (in inch/sec). For example, if a given carrier is exhibiting some I-CPU or I-CPU which is at or near a level which is unacceptable, when the carrier is used in a developer composition at a given process speed, the process speed can be increased to reduce the residence time of carrier in the toning nip area and obtain a decrease in I-CPU. Alternatively, increasing process speed by a factor of ten, such as from 5 inch/sec to 50 inch/sec, would allow one to utilize a carrier with a resistivity reduced by a factor of ten, i.e., for example, from $1\times10^{6}$ to $1\times10^{5}$ ohm-cm, and obtain similar I-CPU performance. Similarly, the geometry of the toning nip area can be altered, for example, so as to decrease the width of the toning nip area. This could be achieved, for example, by placing the photoconductive surface on a cylindrical drum, or if the surface is already on a drum, then by reducing the diameter of such drum. A reduction in the toning nip width by a factor of two, would similarly translate to a reduction in resistivity for the carrier by a factor of two as well.

According to the invention, I-CPU can be limited such that, in terms of deposition density for carrier (as described in Examples 43–52 hereinafter), such deposition density is desirably less than about 0.01 g/in$^2$, preferably less than about 0.001 g/in$^2$, and more preferably less than about 0.0001 g/in$^2$.

In preferred embodiments, the present invention contemplates use of certain hard magnetic materials as a carrier in an electrographic process, wherein the carrier has increased conductivity relative to conventionally used hard magnetic materials. In one embodiment, the carrier is a hard magnetic material substituted with multi-valent metals to increase the conductivity of the carrier. In another embodiment, a conductive metal oxide composition is placed on a core of a hard magnetic material. Both are discussed hereinafter. While there is discussion of these embodiments in some detail hereinafter, including the examples, it is not intended to limit the invention to these particular embodiments. It should be understood that other hard magnetic materials may be used in practicing the invention, provided they have the requisite conductivity and $(Q/m)_{carrier}$ parameters, and that they are otherwise used with the appropriate operating parameters for the methods described herein.

Conductive carriers substituted with multi-valent metals

The present invention, in one embodiment, contemplates use of carriers substituted with an effective amount of at least one multi-valent metal ion into the crystalline lattice of a hard magnetic material, preferably a hard magnetic ferrite having a hexagonal crystal structure, the metal ion corresponding to the formula $M^{n+}$, where n is an integer of at least 4, i.e, 4, 5, or 6, so as to reduce the resistivity of the material while still maintaining desirable magnetic properties. Thus, the resistivity of hard hexagonal ferrite carrier materials can be reduced from approximately $1\times10^{11}$ to approximately $1\times10^{5}$ ohm-cm, and preferably the resistivity and $(Q/m)_{carrier}$ are within the ranges specified hereinabove for inhibiting I-CPU, without affecting the high magnetic properties of the ferrite material.

While not wishing to be bound by theory, it is believed, from size and charge considerations of the cations to be substituted, that the mechanism by which the resistivity of the ferrite materials are decreased is due to substitution of the above-described multi-valent metal ion into the iron lattices of the hexagonal ferrite crystal structure, rather than by replacement of $Sr^{2+}$ $Ba^{2+}$, or $Pb^{2+}$ in the sub-lattice or interstitially in the hexagonal ferrite lattice. In doing so, the $M^{n+}$ multi-valent metal ion substituents force charge compensation in the ferric ($Fe^{3+}$) laftice; i.e., ferrous ($Fe^{2+}$) cations form. The $Fe^{2+}/Fe^{3+}$ charge couple thereby created provides a semi-conductive electronic pathway, resulting in ferrite compositions of higher conductivity.

In a preferred embodiment, a hard magnetic ferrite material doped with the $M^{n+}$ multi-valent metal ion can be represented by the formula:

$$PFe_{12-x}M_xO_{19}$$

wherein:

P is selected from strontium, barium, or lead;

M is selected from at least one of antimony, arsenic, germanium, hafnium, molybdenum, niobium, silicon, tantalum, tellurium, tin, titanium, tungsten, vanadium, zirconium, or mixtures thereof; and x is less than about 0.6.

In especially preferred embodiments, P is selected from either strontium or barium, and more preferably strontium due to cost, magnetic properties, and environmental concerns. M is preferably selected from silicon, zirconium, tin, or titanium due largely to cost and availability concerns. The amount of the multi-valent metal ion employed is preferably sufficient to yield a value for x of less than about 0.3, and more preferably less than about 0.2 due to I-CPU concerns. If the multi-valent metal ion is employed in an amount greater than 0.6, the conductivity does not significantly increase relative to ferrites containing a lesser amount of the multi-valent metal ion. A further advantage associated with the hard magnetic ferrites of the present invention is that by conducting a relatively light doping of the multi-valent metal ion into the ferrite material, one can see significant improvement in development efficiency, as is exemplified by the examples hereinbelow, as well as in copending U.S. patent application Ser. No. 09/572,988, incorporated herein by reference in its entirety. Also, with respect to preparation of such hard magnetic materials, it is believed that substitution of such metal ions into the iron lattice offers processing advantages relative to a substitution into the $Sr^{2+}$ $Ba^{2+}$, or $Pb^{2+}$ sub-lattice.

With respect to the amount of the $M^{n+}$ multi-valent metal ion substituted into the hard magnetic material, the amount substituted should be sufficient to increase the conductivity at least about one order of magnitude, i.e., a reduction in resistivity of at least about $1\times10^1$ ohm-cm. Preferably, in terms of the x value as mentioned above, the amount of metal substituted should be sufficient to give an x value of from about 0.01 to about 0.6, and preferably an amount sufficient to yield an x value of from about 0.02 to less than about 0.3, and more preferably an amount sufficient to yield an x value of from about 0.03 to less than about 0.2 is employed. It is preferred that the amount of the $M^{n+}$ multi-valent metal ion substituted into the crystalline lattice be limited such that the resulting structure comprises substantially a single-phase hexagonal crystalline structure. While the amount of $M^{n+}$ multi-valent metal ion employed can vary somewhat depending upon the $M^{n+}$ multi-valent metal ion and sintering conditions utilized in the preparation of the ferrite particles, the amount of the $M^{n+}$ multi-valent metal ion can generally be added in an amount of up to about 10 percent by weight of the ferrite material and still maintain sufficiently high magnetic properties to tightly adhere the developer nap to the sleeve of the developer station. As the quantity of the $M^{n+}$ multi-valent metal ion added exceeds the foregoing range, additional phases in the $PO/MO_{n/2}/Fe_2O_3$ phase diagram can form. The presence of a minor amount, i.e., preferably less than 50 wt % based on total weight of carrier, of such additional phases does not adversely impact the beneficial properties of a substituted hexagonal crystal structure as previously described.

The preparation of hard magnetic materials generally, and hard, hexagonal crystal structure ferrites (Ba, Sr or Pb) in particular, are well documented in the literature. Any suitable method of making the hard magnetic particles may be employed, such as the methods disclosed in U.S. Pat. Nos. 3,716,630, 4,623,603 and 4,042,518, the teachings of which are incorporated herein by reference in their entirety; European Patent Application No. 0 086 445; "Spray Drying" by K. Masters published by Leonard Hill Books London, pages 502–509 and "Ferromagnetic Materials", Volume 3 edited by E. P. Wohlfarth and published by North-Holland Publishing Company, Amsterdam, N.Y., Oxford, pages 315 et seq, the teachings of which are also incorporated herein by reference.

Hard magnetic materials containing at least one multi-valent metal ion substituted into the crystalline lattice as described hereinabove can be prepared in a similar manner as described in the preceding paragraph by adding a source of the multi-valent metal ion to the formulation so that the metal ion is doped into the crystalline structure. For example, if the hard magnetic material to be prepared is a hard magnetic strontium ferrite containing from about 1 to about 5 percent by weight of the multi-valent metal in its oxide or an oxide precursor form, then from about 8 to 12 parts $SrCO_3$, about 1 to 5 parts of a source of the metal ion and 85 to 90 parts of $Fe_2O_3$ are mixed with a dispersant polymer, gum arabic, and water as a solvent to form a slurry. The solvent is removed by spray drying the slurry and the resultant green beads are fired at from about 1100° C. to about 1300° C. in an oxidizing environment to form the desired hard magnetic material described above. The hard magnetic material is then deagglomerated to yield the component carrier bead particles with a particle size generally required of carrier particles, that is, less than about 100 $\mu$m and preferably from about 3 to 65 $\mu$m, and the resulting carrier particles are then permanently magnetized by subjecting them to an applied magnetic field of sufficient strength to induce a permanent magnetic hysteresis behavior.

In addition to substitution of the foregoing multi-valent metal ions into the hard magnetic material's crystalline structure, the present inventors have also found that substitution of lanthanum in controlled amounts into a hard magnetic ferrite material can be done and provide a carrier which has good I-CPU performance, as illustrated by Examples 5–10 below. Such carriers comprise a hard magnetic ferrite material having a single-phase hexagonal crystal structure and may be represented by the formula:

$$P_{1-y}La_yFe_{12}O_{19}$$

wherein:

P is selected from strontium, barium, or lead; and y is less than 0.1.

Such carriers may be prepared using a source compound for the lanthanum metal ions generally in accordance with the foregoing metal substitution method and the method described in U.S. Pat. No. 4,764,445, the relevant teachings of which are incorporated herein by reference.

With respect to the foregoing substituted ferrite carriers, the resistivity of the carrier is reduced to a value within a range of from about $1\times10^{10}$ ohm-cm to about $1\times10^{5}$ ohm-cm, more preferably from about $5\times10^{9}$ ohm-cm to about $1\times10^{6}$ ohm-cm, and even more preferably from about $5\times10^{9}$ ohm-cm to about $1\times10^{7}$ ohm-cm. The foregoing resistivity ranges are preferred, since a resistivity value within such ranges can inhibit or at least reduce the amount of I-CPU without affecting the high magnetic properties of the hard magnetic material. It is also preferred that $(Q/m)_{carrier}$ for the carrier particles in the developer composition be greater than 1 $\mu$C/g as previously described. Thus, the carrier particles of the present invention can, in such embodiments, provide high levels of development efficiency (and thereby a faster electrographic imaging process), without significant, or at least undesirable, levels of I-CPU, as is exemplified by the examples which follow hereinafter.

Conductive carriers with metal oxide coating composition

The present invention further contemplates, in another embodiment, use of a carrier comprised of a core of a hard magnetic material, preferably a hard magnetic ferrite, that has a conductive metal oxide composition deposited thereon and reacted with the hard magnetic material so as to reduce the overall resistivity of the carrier, while still maintaining the desirable magnetic properties of the hard magnetic material. The composition is deposited onto the core in either a continuous or discontinuous form.

In preferred embodiments, the outer surface of the hard magnetic core defines a transition zone which extends into the magnetic core, i.e., the transition zone is an area within the hard magnetic material near the outer surface of the core. For example, in the event the core is a particle that is spherical or nearly spherical in shape, the transition zone may be visualized as a shell whose outer surface coincides with the outer surface of the particle. Within the transition zone, the hard magnetic material's crystal structure preferably comprises a gradient of metal ions corresponding to the formula $M^{n+}$, where M and n are as previously defined for the metal oxide composition disposed on the core, which metal ions are substituted into the hard magnetic material's crystalline lattice. By "gradient" it is meant that the metal ion concentration is greatest near the outer surface of the core, and such concentration within the crystal lattice decreases at levels deeper within the core. While not wishing to be bound by theory, it is believed, from size and charge considerations of the $M^{n+}$ cations disclosed herein, that the resistivity of a hard magnetic ferrite could be decreased by substitution of the above-described multi-valent metal ions into the iron lattices of the hexagonal ferrite crystal structure, rather than by replacement of $Sr^{2+}$ $Ba^{2+}$, or $Pb^{2+}$. In doing so, the $M^{n+}$ multi-valent metal ion substituents as described hereinabove force a charge compensation in the ferric ($Fe^{3+}$) lattice; i.e., ferrous ($Fe^{2+}$) cations form. The $Fe^{2+}/Fe^{3+}$ charge couple thereby created provides a semi-conductive electronic pathway, resulting in ferrite compositions of higher conductivity. As a result, the conductive metal oxide compositions of the present invention are generally tightly adherent to the core particle, and do not easily flake or spall off when used in an electrographic process.

Thus, by placing the metal oxide composition onto the core as described above, the resistivity of hard magnetic carrier material can be reduced from approximately $1\times10^{11}$ ohm-cm by at least about one order of magnitude, i.e. to approximately $1\times10^{10}$ ohm-cm. By use of the term "conductive" in reference to the carrier and/or its metal oxide composition, it is meant that placing such composition on the core can result in a reduction of the carrier's resistivity of at least about one order of magnitude as mentioned above relative to a carrier of the hard magnetic material without said composition being disposed thereon.

Preferably the resistivity of the carrier is reduced to a value within a range of from about $1\times10^{10}$ ohm-cm to about $1\times10^{5}$ ohm-cm, more preferably from about $5\times10^{9}$ ohm-cm to about $1\times10^{6}$ ohm-cm, and even more preferably from about $5\times10^{9}$ ohm-cm to about $1\times10^{7}$ ohm-cm. The foregoing resistivity ranges are preferred, since a resistivity value within such ranges can inhibit or at least reduce the amount of I-CPU without affecting the high magnetic properties of the hard magnetic material. It is also preferred that $(Q/m)_{carrier}$ for the carrier particles in the developer composition be greater than 1 $\mu$C/g as previously described. Thus, the carrier particles of the present invention can, in such embodiments, provide high levels of development efficiency (and thereby a faster electrographic imaging process), without significant, or at least undesirable, levels of I-CPU, as is exemplified by the examples which follow hereinafter.

Using a qualitative method for determining the I-CPU performance of a developer using a magnetic carrier, as described in the examples which follow hereinafter, one can describe the amount of carrier particles which are separated from the brushed nap of the development zone and deposited onto the electrostatic image being developed. In many instances, the conductive carriers of the present invention can exhibit no apparent deposition of carrier into the image, or only weak to light levels of deposition (a level of 2 or below based on the qualitative I-CPU determination described in the examples), and preferably, exhibit no visual evidence of deposition on the photoconductor (a level of 0 in the qualitative test) when the carriers of the invention are used in a electrographic process. A quantitative method for determining I-CPU by measurement of carrier deposition density (as previously mentioned above) is described in detail hereinafter in conjunction with Examples 43–52.

As a matter of preference, the carrier has a coercivity of at least about 300 Oersteds when the hard magnetic material is magnetically saturated. Also as a matter of preference, the carrier has an induced magnetic moment of at least about 20 EMU/gm when the material is in an externally applied field of 1000 Oersteds.

In a preferred embodiment, the carrier has a core of a hard magnetic ferrite material with a single-phase, hexagonal crystal structure. The core preferably has an outer surface with a metal oxide composition disposed thereon represented by the formula $MO_{n/2}$, wherein M is at least one multi-valent metal represented by $M^{n+}$ with n being an integer of at least 4. Preferably, n is 4, 5 or 6, and more preferably, n is 4 or 5. Most preferably, n is 4.

In preferred embodiments, the metals for the conductive metal oxide composition are any metallic element that can form a multi-valent metal ion in the hard magnetic material's crystal structure such that n in the foregoing formula is 4 or more. Such metals include, for example, antimony, arsenic, germanium, hafnium, molybdenum, niobium, silicon, tantalum, tellurium, tin, titanium, tungsten, vanadium, zirconium, and mixtures thereof. Preferably, the metal is selected from silicon, zirconium, tin, titanium, or mixtures thereof, which metals are more readily available and therefore have a relatively low raw material cost. Examples of metal oxides which may be employed include $GeO_2$, $ZrO_2$, $TiO_2$, $SnO_2$, and mixtures thereof.

The amount of metal oxide composition employed should be that which yields a conductive carrier, i.e., a drop in resistivity of at least about $1\times10^1$ ohm-cm relative to a carrier of the hard magnetic material without the metal oxide thereon as described above. Desirably, the metal oxide composition may be applied in an amount of from about 0.01 to about 3 weight percent based on total weight of the carrier. Preferably, the metal oxide composition is present in an amount of from about 0.02 to about 2 weight percent, and more preferably from about 0.025 to about 1 weight percent based on total carrier weight.

Optionally, the conductive metal oxide composition on the core may further comprise at least one second metal oxide which does not substantially contribute toward enhancement of carrier conductivity, but may add charge tunability and/or coating (deposit) integrity, such as a glassy boron oxide ($B_2O_3$) co-deposit, but preferably the second metal oxide is an alkali metal oxide, such as lithium oxide, potassium oxide, sodium oxide, or mixtures thereof, which can enhance conductivity, even when coated onto the carrier without a co-deposit of the multi-valent metal oxide.

Where a second metal oxide is employed in the conductive metal oxide composition, it is generally present in an amount of from 0.01 to about 1 weight percent, based on total carrier weight.

The preparation of magnetic ferrites generally and hard, hexagonal crystal structure ferrites (Ba, Sr or Pb) in particular, are well documented in the literature. Any suitable method of making the ferrite particles may be employed, such as the methods disclosed in U.S. Pat. Nos. 3,716,630, 4,623,603 and 4,042,518, the teachings of which are incorporated herein by reference in their entirety; European Patent Application No. 0 086 445; "Spray Drying" by K. Masters published by Leonard Hill Books London, pages 502–509 and "Ferromagnetic Materials", Volume 3 edited by E. P. Wohlfarth and published by North-Holland Publishing Company, Amsterdam, N.Y., Oxford, pages 315 et seq, the teachings of which are also incorporated herein by reference.

In general, the conductive carriers of the present invention can be prepared by a solution coating and firing technique as described hereinafter. Initially, a hard magnetic material in particulate form is provided, which can be prepared by any method known to the art, such as those methods described in the foregoing art references. As such, the particulate material functions as the core for the carriers of the present invention. The particulate core material is then admixed with a solution comprising a solvent and at least one metal oxide precursor compound. The admixture is then heated, preferably with agitation as necessary, to remove solvent therefrom and provide a coating of the at least one metal oxide precursor compound on the surface of the core particles. After placing a coating of the metal oxide precursor compounds on the core particles, the so-coated particles are fired in an oxidizing atmosphere at a temperature sufficient to form the desired metal oxide composition on the outer surface of the core particles.

When admixing the particulate core material with the metal oxide precursor solution, the amount of solution used should be sufficient to at least wet the surfaces of the particulate ferrite material. A significant excess of the solution is undesirable, since the solvent in the solution must be removed in subsequent processing steps.

The solution of at least one metal oxide precursor compound may be prepared by dissolving at least one metal oxide precursor compound into a suitable solvent. Desirably, the solvent should be easily vaporized since the preparation method disclosed herein involves removal of the solvent prior to formation of the conductive metal oxide composition. Suitable solvents include water, and other common organic solvents such as methanol, ethanol, isopropanol, toluene, hexane, and the like. Preferred solvents are water, methanol, and isopropanol. By the term "solution", it is also contemplated that a colloidal dispersion of the metal oxide precursor compound can be used.

The compounds employed for the metal oxide precursor solution are those which, upon firing in an oxidizing atmosphere at the temperatures described below, yield the desired metal oxides. Desirably, the compounds are those which may readily be dissolved into the above-described solvents and yield the metals as described hereinabove. Generally, metal salts of organic acids, carbonates, halides, and nitrates are dissolvable and/or dispersible in common solvents and yield good results.

The amount of the at least one metal oxide precursor compound employed in the above-described coating solution is selected such that, upon firing, a metal oxide composition is obtained which is within the weight percent ranges previously given as to the proportion of the metal oxide composition in the final conductive carrier particles. Generally, an amount of from about 0.01 to about 5 weight percent of the metal oxide precursor compound in the solution is sufficient.

After admixing the ferrite core particles with the coating solution, heat is applied to the admixture to remove excess solvent therefrom and obtain dry, or nearly dry, particles coated with the metal oxide precursor compounds. This step may be accomplished by heating the admixture under moderate heat of about 100 to about 150° C. for a time sufficient to remove the solvent without significant conversion of the metal oxide precursor compounds to their oxide forms. The pressure used during the drying step can also be reduced in order to use lower temperatures for the drying step.

Figure 3:
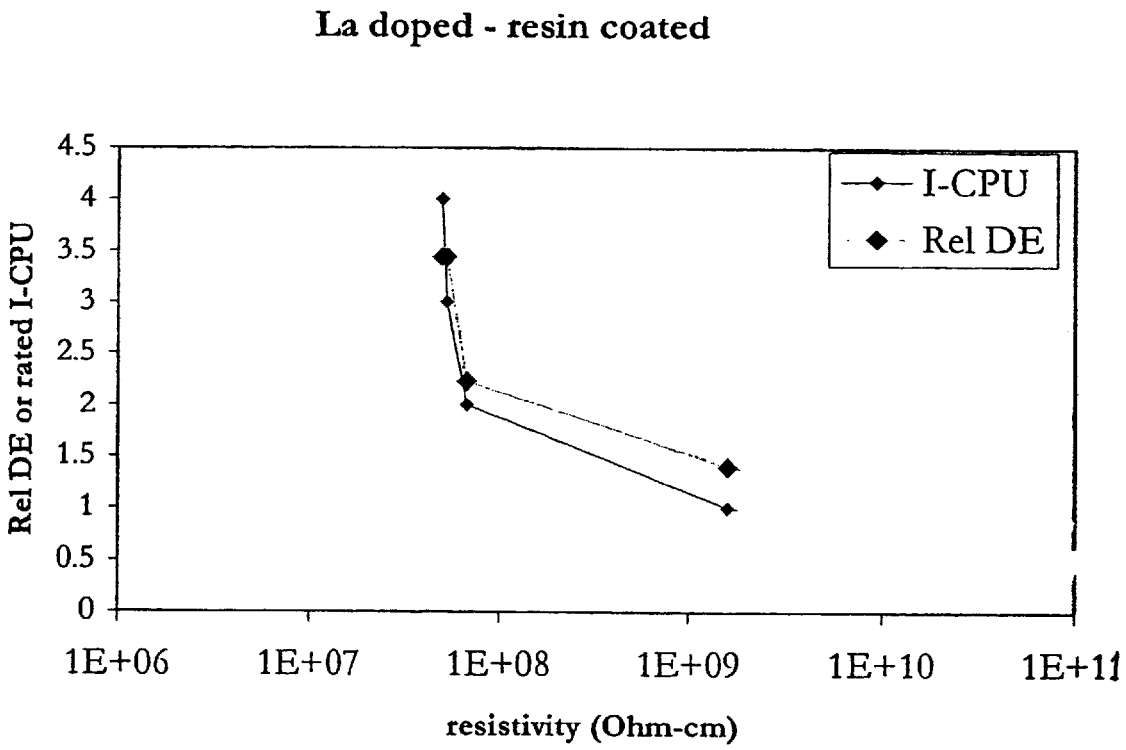
FIG. 3 is a graph of both relative development efficiency (as defined hereinafter) and I-CPU data obtained in connection with Examples 8–10 and Comparative Example C discussed hereinafter.

After removal of the solvent, the so-coated core particles are fired, i.e., calcined, within an oxidizing atmosphere at a temperature sufficient to substantially convert the metal oxide precursor compounds to their oxide form. Generally, this step can be accomplished in a high temperature furnace. The temperature at which the precursor compounds thermally decompose and convert to their oxide form will depend on the precursor selected, but generally, a firing temperature of at least about 250° C. is desired. The firing temperature can be as high as about 1300° C. As mentioned in the examples that follow and as illustrated in FIG. 3, depending on the hard magnetic material selected, as the firing temperature is increased, there is typically a firing temperature at which a significant drop in the resulting carrier resistivity occurs. While not wishing to be bound by theory, it is believed that such significant drop in resistivity is the result of significant reaction of the metal oxide with the core's magnetic material, such that the metal oxide is incorporated into the magnetic material thereby forming a conductive region within the transition zone previously described herein. Preferably, the firing temperature is selected such that the resistivity for the final carrier is within the preferred ranges specified above due to I-CPU concerns.

After firing, the resulting conductive carrier may be deagglomerated to yield the carrier in its final form, that is, beads with a volume average particle diameter of less than 100 $\mu$m, preferably from about 3 to 65 $\mu$m, and more preferably, from about 5 to about 20 $\mu$m. The resulting carrier particles are then magnetized by subjecting them to an applied magnetic field of sufficient strength to yield magnetic hysteresis behavior.

The so-coated hard magnetic ferrites as previously described can have significant improvement in development efficiency, as is exemplified by the examples hereinbelow, as well as in co-pending U.S. patent application Ser. No. 09/572,989 previously incorporated herein by reference.

The present invention includes the use of two types of carrier particles. The first of these carriers comprises a binder-free, particulate hard magnetic material, doped with at least one multi-valent metal ion and/or having a conductive metal oxide composition thereon as described above, and exhibiting the requisite coercivity and induced magnetic moment as previously described. This type of carrier is preferred.

The second is heterogeneous and comprises a composite of a binder (also referred to as a matrix) and a magnetic material exhibiting the requisite coercivity and induced magnetic moment. The hard magnetic material as previously described herein is dispersed as discrete smaller particles throughout the binder. However, binders employed as known to those in the art can be highly resistive in nature, such as in the case of a polymeric binder, such as vinyl resins like polystyrene, polyester resins, nylon resins, and polyolefin resins as described in U.S. Pat. No. 5,256,513. As such, any reduction in conductivity of the magnetic material may be offset by the resistivity of the binder selected. It should be appreciated that the resistivity of these composite carriers must be comparable to the binder-less carrier in order for advantages concerning development efficiency as previously described to be realized. It may be desirable to add conductive carbon black to the binder to facilitate electrical conductance between the ferrite particles.

The individual bits of the magnetic ferrite material should preferably be of a relatively uniform size and sufficiently smaller in diameter than the composite carrier particle to be produced. Typically, the average diameter of the magnetic material should be no more than about 20 percent of the average diameter of the carrier particle. Advantageously, a much lower ratio of average diameter of magnetic component to carrier can be used. Excellent results are obtained with magnetic powders of the order of 5 $\mu$m down to 0.05 $\mu$m average diameter. Even finer powders can be used when the degree of subdivision does not produce unwanted modifications in the magnetic properties and the amount and character of the selected binder produce satisfactory strength, together with other desirable mechanical and electrical properties in the resulting carrier particle.

The concentration of the magnetic material in the composite can vary widely. Proportions of finely divided magnetic material, from about 20 percent by weight to about 90 percent by weight, of composite carrier can be used as long as the resistivity of the particles is that representative of the ferrite particles as described above.

The induced moment of composite carriers in a 1000 Oersteds applied field is dependent on the concentration of magnetic material in the particle. It will be appreciated, therefore, that the induced moment of the magnetic material should be sufficiently greater than about 20 EMU/gm to compensate for the effect upon such induced moment from dilution of the magnetic material in the binder. For example, one might find that, for a concentration of about 50 weight percent magnetic material in the composite particles, the 1000 Oersteds induced magnetic moment of the magnetic material should be at least about 40 EMU/gm to achieve the minimum level of 20 EMU/gm for the composite particles.

The binder material used with the finely divided magnetic material is selected to provide the required mechanical and electrical properties. It should (1) adhere well to the magnetic material, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

The matrix can be organic, or inorganic, such as a matrix composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrenes, and basic monomers such as vinyl pyridines. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting, extruding, or the like and in cutting or shearing to shape the carrier particles; grinding, e.g., in a ball mill to reduce carrier material to appropriate particle size; and sifting operations to classify the particles.

According to one preparation technique, the powdered magnetic material is dispersed in a solution of the binder resin. The solvent may then be evaporated and the resulting solid mass subdivided by grinding and screening to produce carrier particles of appropriate size. According to another technique, emulsion or suspension polymerization is used to produce uniform carrier particles of excellent smoothness and useful life.

The coercivity of a magnetic material refers to the minimum external magnetic force necessary to reduce the induced magnetic moment from the remanance value to zero while it is held stationary in the external field, and after the material has been magnetically saturated, i.e., the material has been permanently magnetized. A variety of apparatus and methods for the measurement of coercivity of the present carrier particles can be employed. For the present invention, a Lakeshore Model 7300 Vibrating Sample Magnetometer, available from Lakeshore Cryotronics of Westerville, Ohio, is used to measure the coercivity of powder particle samples. The magnetic ferrite powder is mixed with a nonmagnetic polymer powder (90 percent magnetic powder; 10 percent polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/gm) is plotted. During this measurement, the sample is exposed to an external field of 0 to ±8000 Oersteds.

The carrier particles may be coated to properly charge the toner particles of the developer. This can be done by forming a dry mixture of the hard magnetic material with a small amount of powdered resin, e.g., from about 0.05 to about 3.0 weight percent resin based on total weight of the magnetic material and resin, and then heating the mixture to fuse the resin. Such a low concentration of resin will form a thin or discontinuous layer of resin on the particles of the magnetic material.

Since the presence of the metal oxide coating is intended to improve conductivity of carrier particles, the layer of resin on the carrier particles should be thin enough that the mass of particles remains suitably conductive. Preferably the resin layer is discontinuous for this reason; spots of bare carrier on each particle provide conductive contact.

Various resin materials can be employed as a coating on the hard magnetic carrier particles. Examples include those described in U.S. Pat. Nos. 3,795,617; 3,795,618, and 4,076,857, the teachings of which are incorporated herein by reference in their entirety. The choice of resin will depend upon its triboelectric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene) For use with toners which are desired to be negatively charged, preferred resins for the carrier include silicone resins, as well as mixtures of resins, such as a mixture of poly(vinylidene fluoride) and polymethylmethacrylate. Various polymers suitable for such coatings are also described in U.S. Pat. No. 5,512,403, the teachings of which are incorporated herein by reference in their entirety.

The developer is formed by mixing the carrier particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

The toner component of the invention can be a powdered resin which is optionally colored. It normally is prepared by compounding a resin with a colorant, i.e., a dye or pigment, either in the form of a pigment flush (a special mixture of pigment press cake and resin well-known to the art) or pigment-resin masterbatch, as well as any other desired addenda known to art. If a developed image of low opacity is desired, no colorant need be added. Normally, however, a colorant is included and it can, in principle, be any of the materials mentioned in Colour Index, Vols. I and II, 2nd Edition. Carbon black is especially useful. The amount of colorant can vary over a wide range, e.g., from about 3 to about 20 weight percent of the toner component. Combinations of colorants may be used as well.

The mixture of resin and colorant is heated and milled to disperse the colorant and other addenda in the resin. The mass is cooled, crushed into lumps and finely ground. The resulting toner particles can range in diameter from about 0.5 to about 25 $\mu$m with a volume average particle diameter of from about 1 to about 16 $\mu$m, and preferably less than 11 $\mu$m, more preferably less than 8 $\mu$m or about 8 $\mu$m or less, and even more preferably less than 6 $\mu$m or about 6 $\mu$m or less. Preferably, the average particle size ratio of carrier to toner particles lies within the range from about 15:1 to about 1:1. However, carrier-to-toner average particle size ratios of as high as 50:1 are useful.

The toner resin can be selected from a wide variety of materials, including both natural and synthetic resins and modified natural resins, as disclosed, for example, in U.S. Pat. No. 4,076,857. Especially useful are the crosslinked polymers disclosed in U.S. Pat. Nos. 3,938,992 and 3,941,898. The crosslinked or noncrosslinked copolymers of styrene or lower alkyl styrenes with acrylic monomers such as alkyl acrylates or methacrylates are particularly useful. Also useful are condensation polymers such as polyesters. Numerous polymers suitable for use as toner resins are disclosed in U.S. Pat. No. 4,833,060. The teachings of U.S. Pat. Nos. 3,938,992, 3,941,898, 4,076,857; and 4,833,060 are incorporated by reference herein in their entirety.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sep. 5, 1979, to J. Ugelstad, as well as by suspension polymerization, such as the method disclosed in U.S. Pat. No. 4,833,060, previously incorporated by reference.

The toner can also contain minor amounts of additional components as known to the art, such as charge control agents and antiblocking agents. Especially useful charge control agents are disclosed in U.S. Pat. Nos. 3,893,935 and 4,206,064, and British Pat. No. 1,501,065, the teachings of which are incorporated herein by reference in their entirety. Quaternary ammonium salt charge agents as disclosed in Research Disclosure, No. 21030, Volume 210, October, 1981 (published by Industrial Opportunities Ltd., Homewell, Havant, Hampshire, P09 1EF, United Kingdom) are also useful.

In an embodiment of the method of the present invention, an electrostatic image is brought into contact with a magnetic brush development station comprising a rotating-magnetic core, an outer non-magnetic shell, and dry developers as described hereinabove. The electrostatic image so developed can be formed by a number of methods such as by imagewise photodecay of a photoreceptor, or imagewise application of a charge pattern on the surface of a dielectric recording element. When photoreceptors are employed, such as in high-speed electrophotographic copy devices, the use of halftone screening to modify an electrostatic image can be employed, the combination of screening with development in accordance with the method for the present invention producing high-quality images exhibiting high Dmax and excellent tonal range. Representative screening methods including those employing photoreceptors with integral half-tone screens are disclosed in U.S. Pat. No. 4,385,823.

Developers comprising magnetic carrier particles in accordance with the present invention when employed in an apparatus such as that described in U.S. Pat. No. 4,473,029 can exhibit a dramatic increase in development efficiency when compared with traditional magnetic ferrite materials as employed in U.S. Pat. No. 4,473,029 when operated at the same voltage differential of the magnetic brush and photoconductive film. For example, when the performance of traditional strontium ferrite carrier particles, similar in all respects except for the presence of the above-described multi-valent metal ion, are compared with the carrier particles of the present invention, the development efficiency can be improved at least from about 50 percent, and preferably up to 100 percent and even 200 percent, all other conditions of development remaining the same. Thus, by employing the carrier particles in accordance with this invention, the operating conditions such as the voltage differential, the exposure energy employed in forming the latent electrostatic image, and the speed of development, may all be varied in order to achieve optimum conditions and results.

The invention is further illustrated by the following examples:

Specific Embodiments of the Invention

In the following examples, all parts and percentages are by weight and temperatures are in degrees Celsius (° C.), unless otherwise indicated.

EXAMPLES 1–4

Preparation and Use of Strontium Ferrite Carriers Substituted with $Ge^{4+}$ A precursor mixture for a strontium ferrite magnetic carrier is initially prepared by the following procedure. A slurry of $Fe_2O_3$ and $SrCO_3$ (at a molar ratio of 5.7:1) is prepared by adding 301.17 grams (g) of $Fe_2O_3$ powder (α-phase—KFH-NA grade—from Toda Kogyo Corporation, Hiroshima, Japan); 48.83 g $SrCO_3$ powder (Type D, from Chemical Products Corporation, Cartersville, Ga.); and 350 g of an aqueous binder solution to a 1250 milliliter (ml) glass bottle. The binder solution is prepared by adding measured amounts of gum arabic (acacia powder, from Eastman Kodak Company, Rochester, N.Y.) and ammonium polymethacrylate (DAXAD 32, from W. R. Grace & Co., Lexington, Mass.) sufficient to provide a solution containing 3.94 wt % gum arabic and 0.33 wt % ammonium polymethacrylate respectively. The pH of the resulting slurry is thereafter adjusted with concentrated $NH_4OH$ to a value of about 8–9.

For Examples 1–4, the above-described strontium ferrite precursor mixture is doped with $Ge^{4+}$ using germanium oxide powder (from Eagle-Picher Industries, Inc., Quapaw, Okla.) as a source, without intentional substitution of the $Ge^{4+}$ ion at either the iron or strontium stoichiometries of the crystalline lattice. For each example, a measured amount of the germanium oxide powder source material as shown in Table I is added as a dry powder to 100 parts of the strontium ferrite precursor mixture and the two are mixed. Table I also gives the value for x in the formula $PFe_{12-x}M_xO_{19}$.

To the slurry is added 300 ml of 1 millimeter (mm) zirconium silicate media beads and the resulting mixture is rolled in a roll mill for at least 24 hours. The resulting mill is pumped to a rotary atomizer operating at a speed of at least 16,000 revolutions per minute (rpm) on a laboratory spray dryer, a portable model available from Nero Atomizer of Copenhagen, Denmark. The spray dryer produces a dried product ("green bead") which is collected with a cyclone.

Firing of the green bead is conducted by placing the green beads in alumina trays and charging them into a high temperature box furnace. The temperature of the furnace is ramped at a rate of 7° C./min to a temperature 500° C., at which point the temperature is maintained at 500° C. for 1 hour to burnout the binder portion of the green bead. Subsequently, the furnace temperature is ramped at a rate of 5° C./min to the final firing temperature. The furnace is held at the firing temperature of 1250° C. for 10 hours, whereupon the furnace is allowed to cool without control (i.e., "free-fall") to room temperature. The fired charges are deagglomerated with a mortar and pestle and screened through a 200 mesh screen to obtain strontium ferrite carrier particles doped with $Ge^{4+}$ multi-valent metal ions.

The resistivities measured for each resulting carrier are shown in Table I below.

Static resistivity is measured using a cylindrically-shaped electrical cell. The cell employed has a cylindrical chamber therein which is concentric with the centerline of the cell. The cell is in two parts, an upper section with an electrode piston located concentrically therein and aligned along the centerline of the cylinder, and a bottom section with an electrode base. The upper section connects to the bottom section, thereby forming the cell's overall cylindrical shape. The circular bottom surface of the piston within the upper section and the circular base of the bottom section define the ends of the cylindrical chamber within the cell. The piston can be actuated and extended downwardly along the centerline of the cell by a small lever that extends radially outward from the cylinder. The base of the bottom section of the cell has a small, centered electrode therein. The piston in the upper section is itself an electrode and thereby forms the opposing electrode. To use the cell, approximately 2.00 g of carrier to be tested is placed on the circular metal base in contact with the electrode. The top portion of the cell is placed on the bottom electrode base and aligned. The release lever is lowered and the piston electrode from the upper section is lowered onto the powder. The depth of the powder is adjusted by physical rotation of the top portion of the cell to give a spacing of 0.04 inches. The average resistivity (in ohm-cm) is determined by measurement of the electrical current flow through the cell using a Keithley Model 616 current meter (from Keithley Corporation, Cleveland, Ohio) for three applied voltages in a range of 10–250 V. Resistivity is determined using Ohm's law.

For each example, the resulting doped carrier is used to prepare a two-component developer using a yellow polyester toner prepared substantially as described in U.S. Pat. No. 4,833,060, the teachings of which are incorporated herein in their entirety. The toner is made using 93 wt % of a polyester resin binder (KAO P, from Kao Corporation, Tokyo, Japan), 1.0 wt % of an aluminum complex of di-tert-butyl salicylic acid charge-control agent (BONTRON E-88, from Orient Chemical Co. Ltd., Osaka, Japan), and 7.0 wt % of yellow pigment 180 (from BASF AG, Ludwigshafen, Germany), wherein the foregoing weight percentages are based on total weight of the toner. The toner prepared has an average particle size of 7.1 μm, as determined by a COULTER COUNTER® device, from Beckman Coulter, Inc., Fullerton, Calif. The developer is produced by mixing together each carrier with the above-described toner using a toner concentration (TC) of about 6 wt % (the actual value for TC is shown in Table I). For each example, the charge-to-mass ratio (Q/m) is measured and the value obtained is also shown in Table I.

Toner charge to mass (Q/m) is measured in microcoulombs per gram (μC/g) within a "MECCA" device described hereinafter, after being subjected to the "exercise periods", also as described hereinafter.

The first exercise period consists of vigorously shaking the developer to cause triboelectric charging by placing a 4–7 g portion of the developer into a 4 dram glass screw cap vial, capping the vial and shaking the vial on a "wrist-action" robot shaker operated at about 2 Hertz (Hz) and an overall amplitude of about 11 centimeters (cm) for 2 minutes. The charge, if obtained at this point, is commonly referred to as the "fresh" charge in the tables that follow hereinafter.

The developer is also subjected to an additional, exercise period of 2 minutes and/or 10 minutes on top of a rotating-core magnetic brush. The vial as taken from the robot shaker is constrained to the brush while the magnetic core is rotated at 2000 rpm to approximate actual use of the developer in an electrographic process. Thus, the developer is exercised as if it were directly on a magnetic brush, but without any loss of developer, because it is contained within the vial. Toner charge level after this exercise is designated as "2 min BB" or "10 min BB" in the tables hereinafter.

The toner Q/m ratio is measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram ($\mu$C/g) is calculated by dividing the accumulated charge by the mass of the deposited toner taken from the upper plate.

TABLE I $Ge^{4+}$ addenda @ 1250° C.

| Example No. | x | $GeO_2$ level pph | resistivity ohm-cm | 10 mm Q/m $\mu$C/g | TC wt % |
|---|---|---|---|---|---|
| 1 | 0.027 | 0.25 | $2.0 \times 10^8$ | −49.6 | 6.6 |
| 2 | 0.053 | 0.5 | $1.1 \times 10^8$ | −55.2 | 6.6 |
| 3 | 0.106 | 1.0 | $9.5 \times 10^6$ | −58.9 | 6.3 |
| 4 | 0.158 | 1.5 | $3.4 \times 10^6$ | −38.5 | 6.0 |

As can be seen from Table I, static resistivity drops about two orders of magnitude over Examples 1–4.

The performance of the toners prepared using the carriers produced by Examples 1–4 is determined using an electrographic device as described in U.S. Pat. No. 4,473,029, the teaching of which have been previously incorporated herein in their entirety. The device has two electrostatic probes, one before a magnetic brush development station and one after the station to measure the voltage on an organic photoconductive film before and after development of an electrostatic image on the photoconductive film. The voltage of the photoconductor is set at −550 volts and the magnetic brush is maintained at −490 volts, for a total offset of +60 volts. The shell and photoconductor are set at a spacing of 0.020 inches, the core is rotated clockwise at 1000 rpm, and the shell is rotated at 15 rpm counter-clockwise. Through the charging station, the photoconductor is set to travel at a speed of 2 inches per second, while in the development section the photoconductor is set to travel at a speed of 5 inches per second. The nap density is 0.24 g/in$^2$. The carrier particles and toner used are those as prepared in Examples 1–4 hereinabove, respectively. The voltage on the photoconductor after charging and exposure to a step-wedge density target is measured by the first probe after development, the voltage on the photoconductor film in the developed areas is measured by the second probe. The development efficiency is calculated for a high density area by comparison of the pre- and post-exposure voltages on the photoconductor. After development, the voltage on the photoconductive film in developed areas is measured, thereby allowing for calculation of a development efficiency for each example as shown in Table II.

Development efficiency is defined as a percentage of the potential difference between the photoreceptor in the developed image areas before and after toner development divided by the potential difference between the photoreceptor and the magnetic brush prior to development. For example, in a discharged area development configuration with a negative toner, if the photoconductor film voltage is −100 V and the magnetic brush is −500 V, the potential difference is 400 V prior to development. If during development, the film voltage is reduced by −200 V to −300 V in the image areas by the deposition of negative toner particles, the development efficiency would be 200 V/400 V, or 50%. The relative development efficiency (Rel DE) is calculated as a ratio of the measured development efficiency for a given example over the development efficiency of a developer prepared in substantially the same manner, except that the carrier employed has not been treated so as to have $Ge^{4+}$ ions substituted in the strontium ferrite carrier.

The reference to I-CPU is a qualitative determination of the extent to which carrier is being picked-up, i.e., deposited onto the photoconductor, and is determined by visually inspecting the high density region from the step-wedge image and comparing the density of deposited carrier particles. A numerical scale is assigned to various levels of I-CPU deposition, with 0—being none, 1—very weak, 2—weak, 3—weak to moderate, 4—moderate, 5—moderate to high, 6—high, and 7—very high.

TABLE II

Development Efficiencies Obtained Using $Ge^{4+}$ Doped $SrFe_{12}O_{19}$ Carriers

| Example No. | $Ge^{4+}$ level pph | Rel DE* | I-CPU |
|---|---|---|---|
| 1 | 0.25 | 2.08 | 1 |
| 2 | 0.50 | 2.68 | 2 |
| 3 | 1.0 | 2.43 | 3 |
| 4 | 1.5 | 3.49 | 4 |
| Comp. Ex. A | 0.0 | 1.00 | 0 |

*Relative to Comparative Example A.

Comparative Example A

In Comparative Example A, the static resistivity, triboelectric properties, development efficiency, and I-CPU of a commercially-prepared $SrFe_{12}O_{19}$ hard ferrite carrier are measured according to substantially the same procedures as described in Examples 1–4 above. The commercially available carrier is a $SrFe_{12}O_{19}$ hard ferrite from Powdertech International Corporation, Valparaiso, Ind. This carrier is used to make a developer with the same toner described in Examples 1–4. The resistivity measured for the carrier is $2.0 \times 10^{10}$ ohm-cm, the toner Q/m is −71.1 $\mu$C/g, and the TC is 6.3 wt %.

The developer made with the foregoing commercially-prepared $SrFe_{12}O_{19}$ hard ferrite carrier is also tested for its performance in an electrographic process according to substantially the same procedures as set forth in Examples 1–4. All conditions, including the toner concentration and charge are substantially the same. The relative development efficiency would be 1.00 based on the definition of development efficiency described in Examples 1–4 above. The I-CPU level is 0, indicating that no visual deposition of carrier is apparent on the photoconductor.

EXAMPLES 5–10

Preparation of Strontium Ferrite Magnetic Carrier Substituted With $La^{3+}$ For Examples 5–10, the procedure of Examples 1–4 is substantially repeated, except as provided hereinafter. The strontium ferrite precursor mixture prepared as described in Examples 1–4 is doped with $La^{3+}$ using $La_2(CO_3)_3$ powder (from Powdertech International Corporation) as a source. For each example, a measured amount of dry powder to yield an y value in the formula $P_{1-y}La_yFe_{12}O_{19}$ as shown in Table III is added to the precursor mixture prepared in Examples 1–4 and the two components are mixed. After milling and spray drying as in Examples 1–4, the resulting mixture is placed in alumina trays and calcined in a high temperature box furnace at a temperature 1225° C. and maintained at that temperature for 10 hours, whereupon the furnace is allowed to cool to provide a $La^{3+}$ doped strontium ferrite carrier.

In Examples 8–10, the resulting carriers are further coated with 1.5 parts of a silicone resin per 100 parts of carrier. The coating is obtained by curing a silicone resin on the carrier particles as follows. The resin is initially formed by mixing 20 ml of methyltrimethoxysilane (98%, from Aldrich Chemical Company, Inc., Milwaukee, Wis.), 2.2 ml of dimethoxy-dimethylsilane (95%, from Aldrich Chemical Company, Inc.), 1 ml of glacial acetic acid, and 8 ml of distilled water in a glass vessel. The mixture is stirred for one hour, and then allowed to stand overnight to complete hydrolysis. A 1.53 g amount of the above solution, after standing overnight, is mixed with 15 ml of methanol and 50 g of the above-prepared carrier in a suitable vessel, and then the mixture is placed under an infrared heat lamp to remove excess solvent therefrom and obtain substantially dry coated carrier particles. The carrier particles are then placed in a metal tray and heated at a temperature of 230° C. for 2½ hours in an oven to cure the silicone resin. The so-coated carriers are then removed from the oven and allowed to cool to room temperature.

The resistivities measured for each resulting carrier are shown in Table III below.

For each example, the resulting doped carrier is used to prepare a two-component developer using a conventionally prepared ground cyan polyester toner. The toner is made with 93 parts of a polyester resin (FINETONE 382, from Reichhold Chemical Company, Durham, N.C.), 5 parts of copper phthalocyanine pigment, and 2 parts of 3,5-ditertbutyl salicylic acid charge control agent (BONTRON E-88), which toner mixture is ground and classified so as to have an average particle size of 8.0 μm as determined by a COULTER COUNTER® device.

The developer is produced by mixing together each carrier with the above-described toner using a toner concentration (TC) of about 10 wt % (the actual value for TC is shown in Table I). For each example, the charge-to-mass ratio (Q/m) for toner is measured and the values obtained are also shown in Table III.

TABLE III $La^{3+}$ addenda @ 1225° C.

| Example No. | $La^{3+}$ level (v value) | resistivity ohm-cm | 10 min Q/m μC/g | Rel DE* | I-CPU |
|---|---|---|---|---|---|
| 5 | 0.025 | $5.9 \times 10^9$ | −47.2 | 1.46 | 1 |
| 6 | 0.05 | $4.0 \times 10^8$ | −44.7 | 2.41 | 2 |
| 7 | 0.10 | $5.1 \times 10^7$ | −41.9 | 2.81 | 3 |
| Comp Ex. B | 0.20 | $5.8 \times 10^7$ | −35.8 | 3.54 | 4 |
| 8 | 0.025 | $1.6 \times 10^9$ | −43.0 | 1.40 | 1 |
| 9 | 0.05 | $6.7 \times 10^7$ | −48.1 | 2.23 | 2 |
| 10 | 0.10 | $5.3 \times 10^7$ | −55.4 | 3.44 | 3 |
| Comp. Ex. C | 0.20 | $5.0 \times 10^7$ | −59.8 | 3.44 | 4 |

*Relative to a control carrier without the coating and the same toner composition.

As can be seen from Table III, static resistivity drops about two orders of magnitude over the range of $La^{3+}$ added in Examples 5–10. For light levels of $La^{3+}$ ion, the I-CPU levels are less than those obtained with higher levels of $La^{3+}$ doped into the ferrite crystal structure, particularly where y is less than 0.1. The silicone resin coating did not significantly alter the performance of the developers relative to those made without a resin coating.

Comparative Examples B and C

In Comparative Examples B and C, the procedures of Examples 5–10 are substantially repeated, except that the strontium ferrite material is doped with the lanthanum source material in an amount sufficient to yield a y value in the formula $P_{1-y}La_yFe_{12}O_{19}$ of 0.2. For Comparative Example B, the carrier is not coated with the silicone resin, while in Comparative Example C, the carrier is coated with the silicone resin substantially as described for Examples 8–10. The static resistivity, triboelectric properties, development efficiency, and I-CPU of the $La^{3+}$ doped $SrFe_{12}O_{19}$ hard ferrite carrier are measured according to substantially the same procedures as described in Examples 1–4 above. This carrier is used to make a developer with the same toner described in Examples 5–10. The resistivity, triboelectric properties, development efficiencies and I-CPU are measured and are shown in Table III for comparison purposes.

Figure 2:
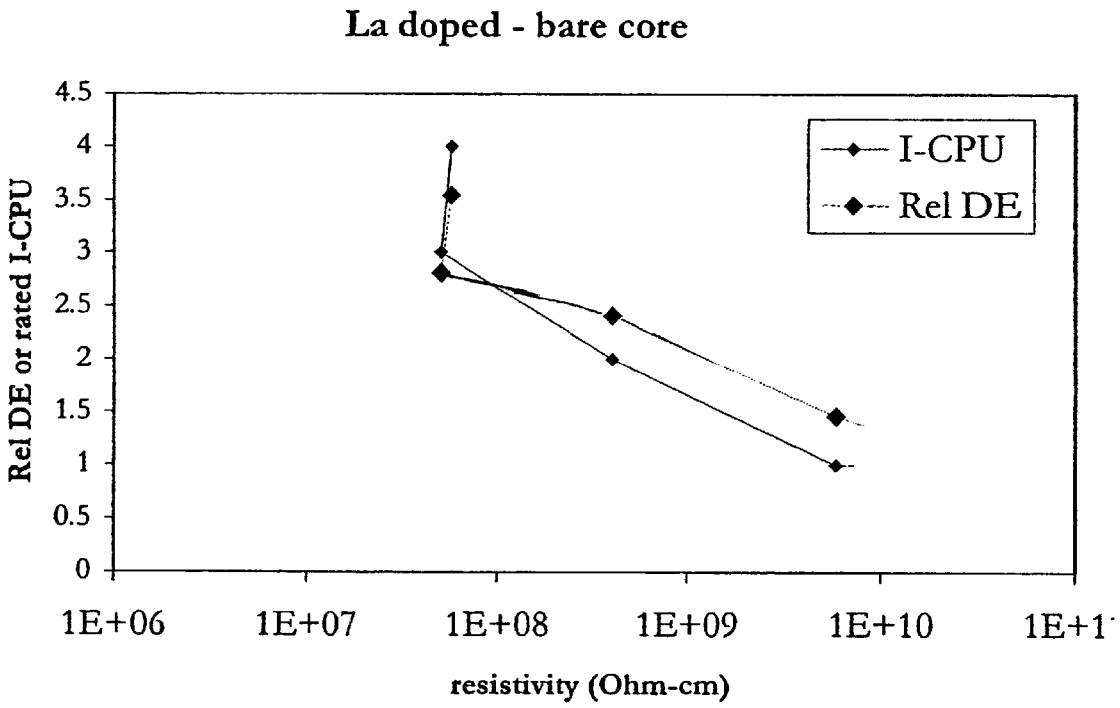
FIG. 2 is a graph of both relative development efficiency (as defined hereinafter) and I-CPU data obtained in connection with Examples 5–7 and Comparative Example B discussed hereinafter.

The results show that at this level of $La^{3+}$ loading, the resulting carriers have high values for relative development efficiency (Rel DE), but have high levels of I-CPU. FIGS. 2 and 3 illustrate the relationship between resistivity and Rel DE and I-CPU. In FIG. 2 the data from Examples 5–7 and Comparative Example B are plotted, with the large diamonds being data points for Rel DE and the small diamonds being data points for I-CPU. FIG. 3 illustrates the data obtained for Examples 8–10 and Comparative Example C, where the large and small diamonds have the same meaning. As can be seen, when resistivity of the carrier drops to less than about $1.0\times10^8$, the values for Rel DE increase significantly but the values for I-CPU also undesirably increase at a significant rate. Thus, FIGS. 2 and 3 show that by decreasing the carrier resistivity with $La^{3+}$ substitution into the ferrite material so that resistivity is from about $1.0\times10^8$ and up to less than the resistivity of the undoped ferrite material, one can operate with relatively high Rel DE values (in comparison to an undoped carrier) but also with acceptable levels for I-CPU.

EXAMPLES 11–13

Preparation and Use of Strontium Ferrite Carriers Coated with $GeO_2$

For Examples 11–13, a commercially-prepared $SrFe_{12}O_{19}$ hard ferrite carrier is coated with 1 part of $GeO_2$ per 100 parts of carrier (0.99 wt % based on total weight of the final carrier particles) and the temperature at which the carrier is fired is varied to show the effects of calcining temperature on the resulting carrier's resistivity and performance.

The coated carrier particles are prepared using $SrFe_{12}O_{19}$ hard magnetic ferrite particles from Powdertech International Corporation. A slurry of the ferrite particles is made by placing a 400 gram (g) amount of the $SrFe_{12}O_{19}$ ferrite particles into a glass dish, along with a combined solution of 66 milliliters (ml) of an ammonium germanate solution and 122 ml of methanol. The ammonium germanate solution is made by adding, with agitation, a 120 g amount of $GeO_2$ powder (chemical grade–99.999% purity), from Eagle-Picher Industries, Inc., into 2,000 ml of distilled water in a appropriately sized glass flask, followed by dropwise addition of 33 ml of a concentrated $NH_4OH$ solution into the vessel to dissolve the $GeO_2$ powder. The resulting ammonium germanate solution has a final pH of 8.5 with a germanium oxide content of 60 grams per liter (g/l).

The slurry as described above is mixed under an infrared heat lamp to dryness, followed by overnight heating in an oven set at 100° C., so as to remove water. At this point, the chemical species present in the ammonium germanate solution have not yet thermally decomposed to an oxide form. The so-coated carrier particles are then fired to thermally decompose the ammonium germanate surface coating by placing an aliquot of at least 20 g of the carrier particles into an alumina tray and charging them into a high temperature box furnace. The temperature of the furnace is ramped at a rate of 7° C./min to a temperature of from 250° C. (Example 11) to 600° C. (Example 13) (the firing temperature for each example is listed in Table IV hereinafter), at which point the temperature is maintained for 2 hours. After firing for two hours, the furnace is allowed to cool without control (i.e., "free-fall") to room temperature. The fired carrier charges are deagglomerated with a mortar and pestle and screened through a 200 mesh screen to obtain strontium ferrite carrier particles having $GeO_2$ deposited thereon.

Figure 4:
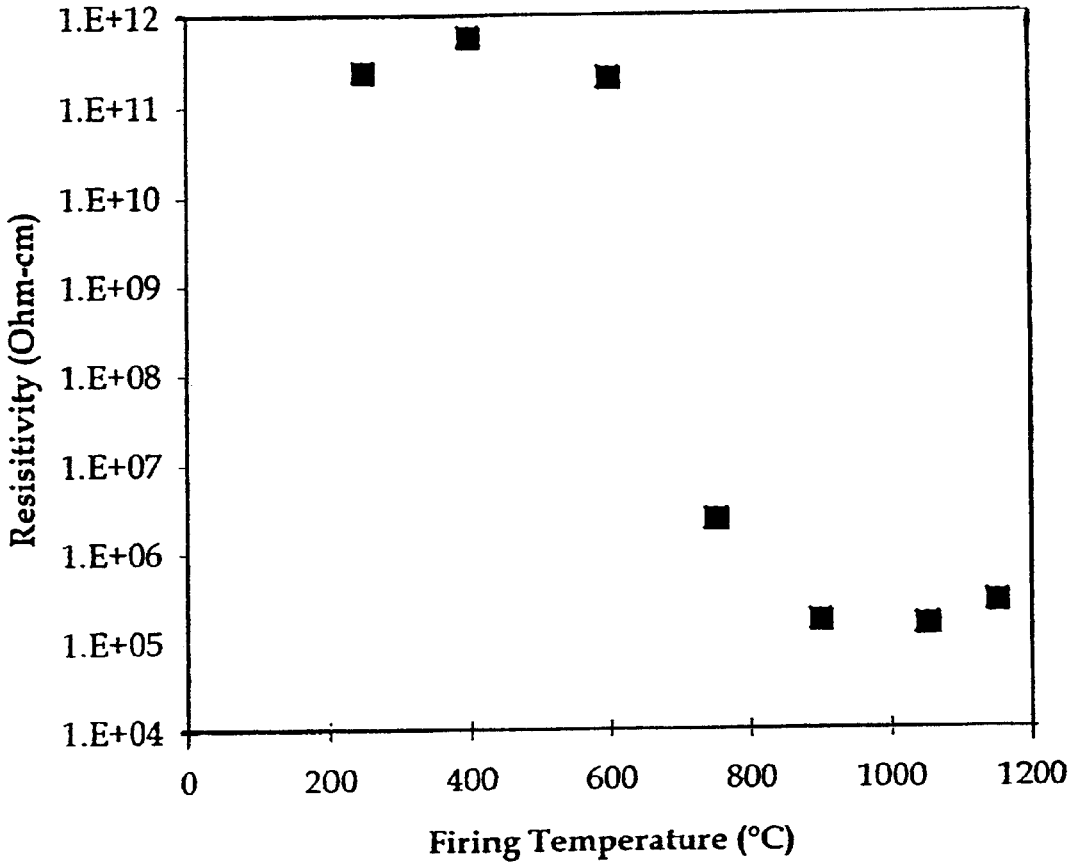
FIG. 4 is a graph of resistivity (in ohm-cm) versus firing temperature for carriers prepared and evaluated in connection with Examples 11–13 and Comparative Example D discussed hereinafter.

The resistivities measured for each resulting carrier are shown in Table IV below. Static resistivity of the carrier is measured by the procedure described in Examples 1–4. The resistivities for each carrier are shown in FIG. 4, which is a graph of resistivity (in ohm-cm) versus firing temperature (in ° C.). As can be seen in FIG. 4, the resistivity of the carrier sharply drops at a firing temperature above 600° C.

For each example, the resulting coated carrier is used to prepare a two-component developer using the yellow polyester toner described in Examples 1–4. The developer is produced by mixing together each carrier with the above-described toner using a toner concentration (TC) of about 6 wt % (the actual value for TC is shown in Table IV). For each example, the toner charge-to-mass ratio $(Q/m)_{toner}$ and TC are measured as described in Examples 1–4 and the values obtained are also shown in Table IV.

The performance of the developers prepared for Examples 11–13 is determined using the same electrographic device and operating conditions as described in Examples 1–4 above. The values obtained for relative development efficiency and I-CPU are also given in Table IV.

TABLE IV

Examples 11–13 - Resistivity & Performance Data

| Example | Temp | Resistivity (ohm- | Fresh | | 10 min BB | | | |
|---|---|---|---|---|---|---|---|---|
| No. | (° C.) | cm) | Q/m | TC | Q/m | TC | Rel DE* | I-CPU |
| 11 | 250 | $2.4 \times 10^{11}$ | −38.8 | 6.4 | −43.5 | 6.0 | 1.45 | 0 |
| 12 | 400 | $5.9 \times 10^{11}$ | −43.6 | 6.1 | −47.3 | 6.3 | 0.99 | 0 |
| 13 | 600 | $2.0 \times 10^{11}$ | −39.4 | 6.3 | −41.8 | 6.2 | 1.54 | 0 |
| Comp. D | 750 | $2.3 \times 10^{6}$ | −32.5 | 6.5 | −35.7 | 6.0 | 2.69 | 6 |

*Relative to a control carrier without the coating and the same toner composition.

As can be seen from Table IV, the relationship between static resistivity, development efficiency and I-CPU is apparent; higher conductivity increases the development rate and also I-CPU. The $GeO_2$ coating, however, permits an opportunity, by selection of firing conditions, to adjust the conductivity of the resulting carrier and its performance when used as a carrier in an electrographic process. As seen in Table IV and FIG. 4, the resistivity drops approximately four orders of magnitude between Example 13 and Comparative Example D (with firing temperatures of 600° C. and 750° C. respectively), and FIG. 4 illustrates generally the trend in static resistivity.

Comparative Example D

In Comparative Example D, the procedures of Examples 11–13 are substantially repeated, except that the ferrite material coated with $GeO_2$ precursor compound is fired at a furnace temperature of 750° C. All other procedures are substantially the same as those in Examples 11–13. The static resistivity, triboelectric properties, development efficiency, and I-CPU of the resulting coated ferrite carrier are measured according to substantially the same procedures as described in Examples 1–4 above. This carrier is used to make a developer with the same toner described in Examples 11–13. The resistivity, triboelectric properties, development efficiencies and I-CPU are measured and are shown in Table IV for comparison purposes. The results are discussed above in connection with Examples 11–13 and are also shown in FIG. 4 for comparison purposes.

EXAMPLES 14–17

Preparation and Use of Strontium Ferrite Carriers Coated with Mixed $GeO_2/B_2O_3$ Coating For Examples 14–17, a commercially prepared $SrFe_{12}O_{19}$ hard ferrite carrier is coated with a mixed $GeO_2/B_2O_3$ coating and used in an electrographic process according to the present invention. The carriers are prepared using generally the procedures as described in Examples 11–13 above, except as provided hereinbelow.

For Example 14, a slurry of the ferrite particles is made by placing a 50 gram (g) amount of the $SrFe_{12}O_{19}$ ferrite particles into a glass dish, along with 30 ml of an ammonium germanate—boric acid solution. The ammonium germanate—boric acid solution is made by adding 10 ml of the ammonium germanate solution made as in Examples 11–13 with 10 ml of distilled water and 10 ml of a methanolic boric acid solution. The methanolic boric acid solution is made by adding 0.22 g of $H_3BO_3$ (reagent grade, from Acros Organics, Morris Plains, N.J.) to the 10 ml of methanol. The procedure of Examples 11–13 is substantially repeated at a furnace temperature of 900° C. to yield a carrier coated with a mixed $GeO_2/B_2O_3$.oxide coating having the stoichiometry of 1.2 pph $GeO_2$ (1.17 wt % based on total weight of the carrier) and 0.5 pph $B_2O_3$ (0.487 wt %).

For Example 15, a slurry of the ferrite particles is made by placing a 50 gram (g) amount of the $SrFe_{12}O_{19}$ ferrite particles into a glass dish, along with 30 ml of an ammonium germanate—boric acid solution. The ammonium germanate—boric acid solution is made by adding 10 ml of the ammonium germanate solution made as in Examples 11–13 with 10 ml of distilled water and 10 ml of a methanolic boric acid solution. The methanolic boric acid solution is made by adding 0.44 g of $H_3BO_3$ to the 10 ml of methanol. The procedure of Examples 11–13 is substantially repeated at a furnace temperature of 900° C. to yield a carrier coated with a mixed $GeO_2/B_2O_3$.oxide coating having the stoichiometry of 1.2 pph $GeO_2$ and 1.0 pph $B_2O_3$.

For Example 16, a slurry of the ferrite particles is made by placing a 50 gram (g) amount of the $SrFe_{12}O_{19}$ ferrite particles into a glass dish, along with 25 ml of an ammonium germanate—boric acid solution. The ammonium germanate—boric acid solution is made by adding 5 ml of the ammonium germanate solution made as in Examples 11–13 with 10 ml of distilled water and 10 ml of a methanolic boric acid solution. The methanolic boric acid solution is made by adding 0.44 g of $H_3BO_3$ to the 10 ml of methanol. The procedure of Examples 11–13 is substantially repeated at a furnace temperature of 900° C. to yield a carrier coated with a mixed $GeO_2/B_2O_3$.oxide coating having the stoichiometry of 0.6 pph $GeO_2$ and 1.0 pph $B_2O_3$.

For Example 17, a slurry of the ferrite particles is made by placing a 50 gram (g) amount of the $SrFe_{12}O_{19}$ ferrite particles into a glass dish, along with 35 ml of an ammonium germanate—boric acid solution. The ammonium germanate—boric acid solution is made by adding 5 ml of the ammonium germanate solution made as in Examples 11–13 with 10 ml of distilled water and 20 ml of a methanolic boric acid solution. The methanolic boric acid solution is made by adding 0.88 g of $H_3BO_3$ to the 20 ml of methanol. The procedure of Examples 11–13 is substantially repeated at a furnace temperature of 900° C. to yield a carrier coated with a mixed $GeO_2/B_2O_3$.oxide coating having the stoichiometry of 0.6 pph $GeO_2$ and 2.0 pph $B_2O_3$.

The resistivities measured for each resulting carrier are shown in Table V below.

For Examples 14–17, the resulting carrier is used to prepare a two-component developer using the yellow polyester toner using the procedure substantially as described in Examples 1–4. For each example, the charge-to-mass ratio (Q/m) in microcoulombs per gram ($\mu$C/g) and toner concentration (TC) in weight percent (wt %) are measured as described in Examples 1–4, and the values obtained are also shown in Table V.

TABLE V

Examples 14–17 - Data For Various $GeO_2/B_2O_3$ Coatings Fired @ 900° C.

| Example No. | $GeO_2/B_2O_3$ (pph) | Resistivity (ohm-cm) | Fresh Q/m | Fresh TC | 2 min BB Q/m | 2 min BB TC | 10 min BB Q/m | 10 min BB TC |
|---|---|---|---|---|---|---|---|---|
| 14 | 1.2/0.5 | $2.4 \times 10^8$ | −80.7 | 4.4 | −65.7 | 5.9 | −62.8 | 5.6 |
| 15 | 1.2/1.0 | $7.1 \times 10^8$ | −74.7 | 5.0 | −72.7 | 5.4 | −62.7 | 5.4 |
| 16 | 0.6/1.0 | $5.7 \times 10^8$ | −79.2 | 4.6 | −74.4 | 5.3 | −59.3 | 5.3 |
| 17 | 0.6/2.0 | $1.6 \times 10^8$ | −81.9 | 3.0 | −66.5 | 5.3 | −62.6 | 5.2 |

For Examples 14–17, the development efficiencies and I-CPU are evaluated according to the procedures substantially as described in Examples 1–4. The data obtained are shown in Table VI.

TABLE VI

Examples 14–17 - Development Performance Data

| Example No. | $GeO_2/B_2O_3$ Content pph) | Resistivity (ohm-cm) | Rel DE* | I-CPU |
|---|---|---|---|---|
| 14 | 1.2/0.5 | $2.4 \times 10^8$ | 1.65 | 1 |
| 15 | 1.2/1.0 | $7.1 \times 10^8$ | 1.15 | 0 |
| 16 | 0.6/1.0 | $5.7 \times 10^8$ | 1.32 | 0 |
| 17 | 0.6/2.0 | $1.6 \times 10^8$ | 1.53 | 0 |

*Relative to a control carrier without the coating and the same toner composition.

EXAMPLES 18–20

Preparation and Use of Strontium Ferrite Carriers Coated with Mixed $GeO_2/Li_2O$ Coating For Examples 18–20, a commercially-prepared $SrFe_{12}O_{19}$ hard ferrite carrier is coated with a mixed $GeO_2/Li_2O$ coating and evaluated in an electrographic process according to the present invention. The coated carriers are prepared using generally the procedures as described in Examples 11–13 above, except as provided hereinbelow.

For Example 18, a slurry of the ferrite particles is made by placing a 50 gram (g) amount of the $SrFe_{12}O_{19}$ ferrite particles into a glass dish, along with 20 ml of an ammonium germanate—lithium acetate solution. The ammonium germanate—lithium acetate solution is made by adding 0.05 g of lithium acetate (98% grade, from Aldrich Chemical Company, Inc.) to 11.7 ml of distilled water and combining the resulting solution with 8.3 ml of the ammonium germanate solution made in Examples 11–13. The procedure of Examples 11–13 is substantially repeated at a furnace temperature of 600° C. to yield a carrier coated with a mixed $GeO_2/Li_2O$ oxide coating having the stoichiometry of 1.0 pph $GeO_2$ (0.99 wt % based on total weight of the carrier) and 0.015 pph $Li_2O$ (0.015 wt %).

For Example 19, a slurry of the ferrite particles is made by placing a 50 gram (g) amount of the $SrFe_{12}O_{19}$ ferrite particles into a glass dish, along with 20 ml of an ammonium germanate—lithium acetate solution. The ammonium germanate—lithium acetate solution is made by adding 0.1 g of the lithium acetate used in Example 18 above into 11.7 ml of distilled water and the resulting solution is combined with 8.3 ml of the ammonium germanate solution made as in Examples 11–13. The procedure of Example 18 is substantially repeated to yield a carrier coated with a mixed $GeO_2/Li_2O$ oxide coating having the stoichiometry of 1.0 pph $GeO_2$ and 0.029 pph $Li_2O$.

For Example 20, a slurry of the ferrite particles is made by placing a 50 gram (g) amount of the $SrFe_{12}O_{19}$ ferrite particles into a glass dish, along with 20 ml of an ammonium germanate—lithium acetate solution. The ammonium germanate—lithium acetate solution is made by adding 0.15 g of the lithium acetate used in Example 18 above into 11.7 ml of distilled water and the resulting solution is combined with 8.3 ml of the ammonium germanate solution made as in Examples 11–13. The procedure of Example 18 is substantially repeated to yield a carrier coated with a mixed $GeO_2/Li_2O$ oxide coating having the stoichiometry of 1.0 pph $GeO_2$ and 0.044 pph $Li_2O$.

The resistivities measured for each resulting carrier in Examples 18–20 are shown in Table VII below.

TABLE VII $GeO_2/Li_2O$ Coatings - Resistivity Data

| Example No. | $Li_2O$ source | Composition $GeO_2/Li_2O$ (pph) | Firing Temp. (° C.) | resistivity (ohm-cm) |
|---|---|---|---|---|
| 18 | $LiCH_3COO2H_2O$ | 1.0/0.015 | 600 | $9.9 \times 10^8$ |
| 19 | " | 1.0/0.029 | " | $7.4 \times 10^8$ |
| 20 | " | 1.0/0.044 | " | $7.5 \times 10^8$ |

For Examples 18–20, the resulting carriers are also used to prepare a two-component developer using the yellow polyester toner and procedure substantially as described in Examples 11–13. For each example, the charge-to-mass ratio (Q/m) in microcoulombs per gram ($\mu$C/g) and toner concentration (TC) in weight percent (wt %) are measured as described in Examples 1–4, and the values obtained are also shown in Table VIII.

TABLE VIII

Examples 18–20 - Performance Data For Various $GeO_2/Li_2O$ Coatings

| Example No. | $GeO_2/Li_2O$ (pph) | Resistivity (ohm-cm) | 10 min BB Q/m | | Rel TC | D E * I-CPU |
|---|---|---|---|---|---|---|
| 18 | 1.0/0.015 | $9.9 \times 10^8$ | −18.5 | 6.1 | 1.83 | 0 |
| 19 | 1.0/0.029 | $7.4 \times 10^8$ | −15.6 | 6.3 | 1.69 | 0 |
| 20 | 1.0/0.044 | $7.5 \times 10^8$ | −21.4 | 6.2 | 1.77 | 0 |

*Relative to a control carrier without the coating and the same toner composition.

EXAMPLES 21–23

Preparation and Use of Strontium Ferrite Carriers Coated with Mixed $GeO_2/Na_2O$ Coating For Examples 21–23, a commercially-prepared $SrFe_{12}O_{19}$ hard ferrite carrier is coated with a mixed $GeO_2/Na_2O$ coating according to the present invention by using two different sources for the $Na_2O$ component. The coated carriers are prepared using generally the procedures as described in Examples 11–13 above, except as provided hereinbelow.

For Example 21, a slurry of the ferrite particles is made by placing a 50 gram (g) amount of the $SrFe_{12}O_{19}$ ferrite particles into a glass dish, along with 20 ml of an ammonium germanate—sodium acetate solution. The ammonium germanate—sodium acetate solution is made by adding 0.05 g of sodium acetate (from Aldrich Chemical Company, Inc.) to 11.7 ml of distilled water and combining the resulting solution to 8.3 ml of the ammonium germanate solution made as in example has 11–13. The procedure of Examples 1–4 is substantially repeated at a furnace temperature of 600° C. to yield a carrier coated with a mixed $GeO_2/Na_2O$ oxide coating having the stoichiometry of 1.0 pph $GeO_2$ (0.99 wt % based on total weight of the carrier) and 0.023 pph $Na_2O$ (0.023 wt %).

For Example 22, a slurry of the ferrite particles is made by placing a 50 gram (g) amount of the $SrFe_{12}O_{19}$ ferrite particles into a glass dish, along with 20 ml of an ammonium germanate—sodium acetate solution. The ammonium germanate—sodium acetate solution is made by adding 0.10 g of the sodium acetate used in Example 21 above into 11.7 ml of distilled water and combining the resulting solution with 8.3 ml of the ammonium germanate solution made as in Examples 11–13. The procedure of Example 21 is substantially repeated to yield a carrier coated with a mixed $GeO_2/Na_2O$ oxide coating having the stoichiometry of 1.0 pph $GeO_2$ and 0.046 pph $Na_2O$.

For Example 23, a slurry of the ferrite particles is made by placing a 50 gram (g) amount of the $SrFe_{12}O_{19}$ ferrite particles into a glass dish, along with 20 ml of an ammonium germanate—sodium acetate solution. The ammonium germanate—sodium acetate solution is made by adding 0.15 g of the sodium acetate used in Example 21 above into 11.7 ml of distilled water and combining the resulting solution with 8.3 ml of the ammonium germanate solution made as in Examples 11–13. The procedure of Example 21 is substantially repeated to yield a carrier coated with a mixed $GeO_2/Na_2O$ oxide coating having the stoichiometry of 1.0 pph $GeO_2$ and 0.068 pph $Na_2O$.

The resistivities measured for each resulting carrier in Examples 21–23 are shown in Table IX below.

TABLE IX $GeO_2/Na_2O$ Coatings - Resistivity Data

| Example No. | $Na_2O$ source | Composition $GeO_2/Na_2O$ (pph) | Firing Temp. (° C.) | resistivity (ohm-cm) |
|---|---|---|---|---|
| 21 | $NaCH_3COO3H_2O$ | 1.0/0.023 | 600 | $5.0 \times 10^8$ |
| 22 | " | 1.0/0.046 | " | $2.0 \times 10^8$ |
| 23 | " | 1.0/0.068 | " | $9.7 \times 10^8$ |

In Examples 21–23, the resulting carriers are also used to prepare a two-component developer using the yellow polyester toner and procedure substantially as described in Examples 1–4. For each example, the charge-to-mass ratio (Q/m) in microcoulombs per gram ($\mu$C/g) and toner concentration (TC) in weight percent (wt %) are measured as described in Examples 1–4, and the values obtained are also shown in Table X.

TABLE X

Examples 21–23 - Data For Various $GeO_2/Na_2O$ Coatings Fired @ 600° C.

| Example No. | $GeO_2/Na_2O$ (pph) | Resistivity (ohm-cm) | 10 min BB Q/m | | Rel TC | D E * I-CPU |
|---|---|---|---|---|---|---|
| 21 | 1.0/0.023 | $5.0 \times 10^8$ | −33.0 | 6.0 | 1.83 | 0 |
| 22 | 1.0/0.046 | $2.0 \times 10^8$ | −30.6 | 6.4 | 1.72 | 0 |
| 23 | 1.0/0.068 | $9.7 \times 10^8$ | −31.1 | 5.5 | 2.07 | 0 |

*Relative to a control carrier without the coating and the same toner composition.

EXAMPLES 24–33

Preparation and Use of Strontium Ferrite Carriers with $TiO_2$ Coatings

For Examples 24–33, a commercially-prepared $SrFe_{12}O_{19}$ hard ferrite carrier is coated with a $TiO_2$ composition according to the present invention. The carriers are prepared using generally the procedures as described in Examples 11–13 above, except as provided hereinbelow.

For Example 24, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 1.065 g of tetrabutylorthotitanate, from Eastman Kodak Company, into 35 ml of methanol. The procedure of Examples 11–13 is substantially repeated at a furnace temperature of 600° C. to yield a carrier coated with 0.25 pph (0.25 wt % based on total weight of the carrier) of $TiO_2$.

For Example 25, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 2.13 g of the tetrabutylorthotitanate into 35 ml of methanol. The procedure of Examples 11–13 is substantially repeated at a furnace temperature of 600° C. to yield a carrier coated with 0.50 pph of $TiO_2$.

For Example 26, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 4.26 g of the tetrabutylorthotitanate into 35 ml of methanol. The procedure of Examples 11–13 is substantially repeated at a furnace temperature of 600° C. to yield a carrier coated with 1.0 pph of $TiO_2$.

For Example 27, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 6.39 g of the tetrabutylorthotitanate into 35 ml of methanol. The procedure of Examples 1–7 is substantially repeated at a furnace temperature of 600° C. to yield a carrier coated with 1.5 pph of $TiO_2$.

For Example 28, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 8.52 g of the tetrabutylorthotitanate into 35 ml of methanol. The procedure of Examples 11–13 is substantially repeated at a furnace temperature of 600° C. to yield a carrier coated with 2.0 pph of $TiO_2$.

For Examples 29–33, the procedures of Examples 24–28 respectively are substantially repeated, except the furnace temperature is 900° C. in each instance.

The resistivities measured for each resulting carrier are shown in Tables XI and XII below.

For Examples 24–33, the resulting carriers are used to prepare a two-component developer with the yellow polyester toner and procedure substantially as described in Examples 11–13. For each example, the charge-to-mass ratio (Q/m) in microcoulombs per gram ($\mu$C/g) and toner concentration (TC) in weight percent (wt %) are measured as in Examples 1–4, and the values obtained are also shown in Tables XI and XII. Relative DE and I-CPU are also evaluated as in Examples 1–4.

TABLE XI

Examples 24–28 - Data For Various $TiO_2$ Compositions Fired @ 600° C.

| Example No. | $TiO_2$ (pph) | Resistivity (ohm-cm) | 10 min BB Q/m | TC | Rel DE* | I-CPU |
|---|---|---|---|---|---|---|
| 24 | 0.25 | $1.8 \times 10^9$ | −45.6 | 6.4 | 1.42 | None (0) |
| 25 | 0.5 | $1.7 \times 10^9$ | −37.7 | 6.0 | 1.40 | None (0) |
| 26 | 1.0 | $2.2 \times 10^9$ | −41.9 | 6.3 | 1.03 | None (0) |
| 27 | 1.5 | $1.9 \times 10^9$ | −29.7 | 6.3 | 1.08 | None (0) |
| 28 | 2.0 | $2.3 \times 10^9$ | −32.0 | 6.4 | 1.60 | None (0) |

*Relative to a control carrier without the coating and the same toner composition.

TABLE XII

Examples 29–33 - Data For Various $TiO_2$ Compositions Fired @ 900° C.

| Example No. | $TiO_2$ (pph) | Resistivity (ohm-cm) | 10 min BB Q/m | TC | Rel DE* | I-CPU |
|---|---|---|---|---|---|---|
| 29 | 0.25 | $1.0 \times 10^7$ | −55.6 | 6.0 | 2.36 | Weak (2) |
| 30 | 0.5 | $7.8 \times 10^6$ | −51.4 | 6.3 | 3.44 | Weak (2) |
| 31 | 1.0 | $2.8 \times 10^7$ | −43.0 | 6.4 | 2.28 | Very Weak (1) |

TABLE XII-continued

Examples 29–33 - Data For Various $TiO_2$ Compositions Fired @ 900° C.

| Example No. | $TiO_2$ (pph) | Resistivity (ohm-cm) | 10 min BB Q/m | TC | Rel DE* | I-CPU |
|---|---|---|---|---|---|---|
| 32 | 1.5 | $9.3 \times 10^7$ | −41.6 | 6.2 | 2.92 | Very Weak (1) |
| 33 | 2.0 | $2.4 \times 10^8$ | −34.2 | 6.2 | 2.31 | None (0) |

*Relative to a control carrier without the coating and the same toner composition.

EXAMPLES 34–39

Preparation and Use of Strontium Ferrite Carriers with $ZrO_2$ Coatings

For Examples 34–39, a commercially-prepared $SrFe_{12}O_{19}$ hard ferrite carrier is coated with a $ZrO_2$ coating according to the present invention. The carriers are prepared using generally the procedures as described in Examples 11–13 above, except as provided hereinbelow.

For Example 34, a slurry of the ferrite particles is made by placing a 100 g amount of the $SrFe_{12}O_{19}$ ferrite particles into a glass dish, along with 35 ml of an aqueous, colloidal zirconium acetate solution (NYACOL dispersion–20% $ZrO_2$ content, from The PQ Corporation, Ashland, Mass.). The zirconium acetate solution is made by combining 2.5 g of the zirconium acetate dispersion with an amount of distilled water sufficient to make up 35 ml of solution. The procedure of Examples 11–13 is substantially repeated at a furnace temperature of 900° C. to yield a carrier coated with 0.5 pph of $ZrO_2$.

For Example 35, a slurry of the ferrite particles is made by placing a 100 g amount of the $SrFe_{12}O_{19}$ ferrite particles into a glass dish, along with 35 ml of an aqueous zirconium acetate solution prepared by combining 5.0 g of the zirconium acetate dispersion with distilled water. The procedure of Examples 11–13 is substantially repeated at a furnace temperature of 900° C. to yield a carrier coated with 1.0 pph of $ZrO_2$.

For Example 36, a slurry of the ferrite particles is made by placing a 100 g amount of the $SrFe_{12}O_{19}$ ferrite particles into a glass dish, along with 35 ml of the aqueous zirconium acetate solution prepared by combining 10 g of the zirconium acetate dispersion with of distilled water. The procedure of Examples 11–13 is substantially repeated at a furnace temperature of 900° C. to yield a carrier coated with 2.0 pph of $ZrO_2$.

For Examples 37–39, the procedures of Examples 34–36 respectively are substantially repeated, except the furnace temperature is 1150° C. in each instance.

The resistivities measured for each resulting carrier are shown in Tables XII and XIV below.

For Examples 34–39, the resulting carriers are used to prepare a two-component developer with the yellow polyester toner and procedure substantially as described in Examples 11–13. For each example, the charge-to-mass ratio (Q/m) in microcoulombs per gram ($\mu$C/g) and toner concentration (TC) in weight percent (wt %) are determined as in Examples 1–4, and the values obtained are also shown in Tables XII and XIV. Relative DE and I-CPU are also evaluated as in Examples 11–13.

TABLE XIII

Examples 34–36 - Data For Various $ZrO_2$ Coatings Fired @ 900° C.

| Example No. | $ZrO_2$ (pph) | Resistivity (ohm-cm) | 10 min Q/m | BB TC | Rel DE* | I-CPU |
|---|---|---|---|---|---|---|
| 34 | 0.5 | $1.2 \times 10^{10}$ | −59.3 | 5.9 | 1.14 | None (0) |
| 35 | 1.0 | $5.3 \times 10^{9}$ | −48.7 | 6.0 | 1.14 | None (0) |
| 36 | 2.0 | $2.8 \times 10^{9}$ | −46.0 | 6.0 | 1.20 | None (0) |

*Relative to a control carrier without the coating and the same toner composition.

TABLE XIV

Examples 37–39 - Data For Various $ZrO_2$ Compositions Fired @ 1150° C.

| Example No. | $TiO_2$ (pph) | Resistivity (ohm-cm) | 10 min Q/m | BB TC | Rel DE* | I-CPU |
|---|---|---|---|---|---|---|
| 37 | 0.5 | $2.2 \times 10^{7}$ | −33.3 | 6.3 | 1.52 | Weak (2) |
| 38 | 1.0 | — | −45.8 | 6.0 | 1.72 | Weak (2) |
| 39 | 2.0 | $8.7 \times 10^{7}$ | −50.5 | 6.0 | 1.56 | Weak (2) |

*Relative to a control carrier without the coating and the same toner composition.
"—" means not measured.

of Examples 11–13 is substantially repeated at a furnace temperature of 900° C. to yield a carrier coated with 1.0 pph of $SnO_2$.

For Example 42, a slurry of the ferrite particles is made by placing a 100 g amount of the $SrFe_{12}O_{19}$ ferrite particles into a glass dish, along with 35 ml of an aqueous tin oxide solution. The solution is prepared by adding 13.34 g of the colloidal tin oxide dispersion of Example 40 to sufficient distilled water to make up a volume of 35 ml. The procedure of Examples 11–13 is substantially repeated at a furnace temperature of 900° C. to yield a carrier coated with 2.0 pph of $SnO_2$.

The resistivities measured for each resulting carrier are shown in Table XV below.

For Examples 40–42, the resulting carriers are used to prepare a two-component developer with the yellow polyester toner and procedure substantially as described in Examples 11–13. For each example, the charge-to-mass ratio (Q/m) in microcoulombs per gram ($\mu$C/g) and toner concentration (TC) in weight percent (wt %) are measured as in Examples 1–4, and the values obtained are also shown in Table XV. Relative DE and I-CPU are also evaluated as in Examples 11–13.

TABLE XV

Examples 40–42 - Data For Carriers with $SnO_2$ Coatings

| Exam. | $SnO_2$ | Fire Temp | Resistivity | Fresh | | 2 min BB | | 10 min BB | | | |
|---|---|---|---|---|---|---|---|---|---|---|---|
| No. | (pph) | (° C.) | (ohm-cm) | Q/m | TC | Q/m | TC | Q/m | TC | Rel DE* | I-CPU |
| 40 | 0.5 | 900 | $7.1 \times 10^{8}$ | −50.0 | 6.0 | −57.4 | 5.9 | −53.4 | 5.7 | 1.79 | 0 |
| 41 | 1.0 | 900 | $1.2 \times 10^{8}$ | −44.2 | 6.0 | −48.4 | 6.1 | −49.5 | 5.9 | 2.08 | 1 |
| 42 | 2.0 | 900 | $1.2 \times 10^{8}$ | −37.0 | 6.2 | −32.7 | 6.2 | −40.5 | 6.1 | 1.53 | 1 |

*Relative to a control carrier without the coating and the same toner composition.

EXAMPLES 40–42

Preparation and Use of Strontium Ferrite Carriers with $SnO_2$ Coatings

For Examples 40–42, a commercially-prepared $SrFe_{12}O_{19}$ hard ferrite carrier is coated with a $SnO_2$ coating according to an embodiment of the present invention. The carriers are prepared using generally the procedures as described in Examples 11–13 above, except as provided hereinbelow.

For Example 40, a slurry of the ferrite particles is made by placing a 100 g amount of the $SrFe_{12}O_{19}$ ferrite particles into a glass dish, along with 35 ml of an aqueous, colloidal tin oxide solution. The aqueous tin oxide solution is made by combining 3.33 g of a colloidal tin oxide dispersion (NYACOL dispersion, from The PQ Corporation) with sufficient distilled water to make up a volume of 35 ml of solution. The procedure of Examples 11–13 is substantially repeated at a furnace temperature of 900° C. to yield a carrier coated with 0.5 pph of $SnO_2$.

For Example 41, a slurry of the ferrite particles is made by placing a 100 g amount of the $SrFe_{12}O_{19}$ ferrite particles into a glass dish, along with 35 ml of an aqueous tin oxide solution. The solution is prepared by adding 6.67 g of the colloidal tin oxide dispersion of Example 40 to sufficient distilled water to make up a volume of 35 ml. The procedure

EXAMPLE 43

In Example 43, a series of two-component developer compositions with varying toner concentration are made from a commercially-available $SrFe_{12}O_{19}$ hard ferrite carrier (from Powdertech International Corporation), which carrier is further coated with a $SnO_2$ coating by substantially following the procedure of Example 41 hereinabove, i.e., the carrier has a 1.0 pph $SnO_2$ coating and is fired at an oven temperature of 900° C. The resistivity of the carrier is measured according to the procedure described in Examples 1–4, and is determined to be $8 \times 10^{7}$ ohm-cm.

The toner employed is prepared using 92 wt % of a conventionally-prepared poly (sytrene-co-butylacrylate) polymer resin, from Eastman Kodak Company, which resin is blended with 1 wt % of an organo-iron complex charge-control agent (T-77, from Hodogaya Chemical Co., Ltd., Kawasaki, Japan), and 7 wt % of carbon black (430 BLACK PEARLS, from Cabot Corporation, Boston, Mass.). The resulting raw toner mixture is ground and sieved to obtain a toner resin powder having an average particle size of 12.2 $\mu$m as determined using a COULTER COUNTER® device.

Five different developer compositions are prepared, one for each of the five runs in Example 43, by mixing together the above-described carrier with varying amounts of the above-described toner so as to obtain developer compositions having a toner concentration (TC) of 6.4, 8.6, 10.7, 13.1, and 15.1 wt % respectively, based on the total weight of the applicable developer composition. For each developer, the resistivity of the developer composition is measured immediately after making the developer composition by using substantially the same equipment and procedure used to determine carrier resistivity as described in Examples 1–4 hereinabove, except that 2.00 g of the so-made developer mixture is employed, rather than 2.00 g of carrier. The values obtained for developer resistivity are shown in Table XVI. For each developer mixture, the toner charge-to-mass ratio—$(Q/m)_{toner}$—is measured according to the procedure of Examples 1–4 hereinabove, and the values obtained are shown in Table XVI. For each developer, the carrier charge-to-mass ratio—$(Q/m)_{carrier}$—is then calculated from the measured $(Q/m)_{toner}$ according to the following equation, with TC expressed as a weight percent:

$$(Q/m)_{carrier}=(Q/m)_{toner}\times(TC/(100-TC))$$

The values for $(Q/m)_{carrier}$ are also shown in Table XVI.

The performance of each of the above-described developer compositions is then evaluated using the electrographic device and procedures substantially as described in Examples 1–4, except as provided hereinafter. To facilitate the quantitative I-CPU analytical procedure described hereinafter, the entire photoconductive film (having rectangular dimensions of 5.5 inch by 8.25 inch, for an area of exposure of 45.375 $in^2$) is biased developed. The grid voltage is set to give about +600 volts (V) potential on the photoconductive film, and a −400 V offset is set to yield a constant +400V potential from the shell to the photoconductive film. The development efficiency is calculated based on the degree to which the +400 V potential is reduced during development of the photoconductive film with each developer composition relative to the original +400 V. The device has a developer station employing a rotating magnetic core having 12 magnetic poles and a magnetic strength of 1000 Gauss. The developer station also has a shell disposed about the rotating core, wherein the surfaces of the shell and photoconductive film are spaced apart from each other and are set to have a spacing of 0.020 inches. The core is rotated clockwise at 1000 rpm, and the shell is rotated at 15 rpm counter-clockwise. Through the charging station, the photoconductive film is set to travel at a speed of 2 inches per second, while in the development section the photoconductive film is set to travel at a speed of 5 inches per second. The nap density is 0.24 $g/in^2$. The toning nip width is 0.375 inches.

The voltage on the photoconductor after charging is measured by a first probe, and after development the voltage on the photoconductive film in the developed areas is measured by a second probe. After development, the voltage on the photoconductive film in developed areas is measured, thereby allowing for calculation of a development efficiency for each run as shown in Table XVI. Relative development efficiency (Rel DE) is determined as in Examples 1–4 in reference to the development efficiency obtained using the developer in Run No. 3 of Example 47.

The I-CPU for each developer composition during each run is determined using a quantitative procedure as described hereinafter. I-CPU is determined in each run by washing the toner (and any developed carrier) off of the photoconductive film after development using at least 15 ml of a solvent consisting of 50 wt % acetone and 50 wt % dichloromethane based on total weight of the mixed solvent. The foregoing mixed solvent is sufficient to dissolve the toner resin, but not the carrier particles that may develop on the photoconductive film. The remaining carrier particles are magnetically collected from the solvent, washed at least 3 times with the mixed solvent, and then dried. The dried carrier particles collected from the photoconductive film are then weighed, and the amount of carrier obtained in each run is listed in Table XVI. Also listed is I-CPU in terms of carrier deposition density, i.e., grams of carrier developed per unit area of photoconductive film, based on 45.375 $in^2$ of area for exposure as previously described.

TABLE XVI

Example 43 - Data For Carrier with 1.0 pph $SnO_2$ Coating (900° C.) and Varying TC Level

| Run No. | Toner Size (μm) | TC (wt %) | $(Q/m)^1$ (μC/g) | $(Q/m)^2$ (μC/g) | DE | Rel DE* | I-CPU (grams) | I-CPU ($g/in^2$) | Dev. Resistivity (Ohm-cm) |
|---|---|---|---|---|---|---|---|---|---|
| 1 | 12.2 | 6.4 | −46.7 | 3.2 | 0.605 | 2.47 | 0.1062 | $2.34\times10^{-3}$ | $1.9\times10^{7}$ |
| 2 | 12.2 | 8.6 | −41.7 | 3.9 | 0.731 | 2.97 | 0.0676 | $1.49\times10^{-3}$ | $2.7\times10^{7}$ |
| 3 | 12.2 | 10.7 | −35.3 | 4.2 | 0.830 | 3.37 | 0.0343 | $7.56\times10^{-4}$ | $4.3\times10^{7}$ |
| 4 | 12.2 | 13.1 | −32.6 | 4.9 | 0.852 | 3.46 | 0.0263 | $5.80\times10^{-4}$ | $5.9\times10^{7}$ |
| 5 | 12.2 | 15.1 | −30.8 | 5.5 | 0.766 | 3.11 | 0.0153 | $3.37\times10^{-4}$ | $9.5\times10^{7}$ |

*Relative to the control carrier as described in Example 43 above.

[1] $(Q/m)_{toner}$

[2] $(Q/m)_{carrier}$

The data in Table XVI illustrates that by varying TC level in the developer composition, for example at a toner average particle size of about 12 μm, one can vary the toner concentration in the developer from about 6 to 15 wt %, based on total weight of the developer, and thereby adjust the $(Q/m)_{carrier}$ value for the developer composition and directly influence the I-CPU characteristic. Therefore, a desirable range for TC, for a developer composition comprised of a carrier with a given level of resistivity within the ranges as recited herein, would be that sufficient to yield a deposition density of desirably less than about 0.01 $g/in^2$, preferably less than about 0.001 $g/in^2$, and more preferably less than about 0.0001 $g/in^2$. The data also suggest that I-CPU can be modulated by the $(Q/m)_{carrier}$ value, particularly when the carrier resistivity is at or near a threshold value where I-CPU would otherwise reach an unacceptable level.

EXAMPLE 44

In Example 44, the procedures described in Example 43 above are substantially repeated, except as provided hereinafter. The commercially-available $SrFe_{12}O_{19}$ hard ferrite carrier is coated with a $SnO_2$ coating by substantially following the procedures of Examples 41 and 43 hereinabove, except that the carrier is fired at an oven temperature of 875° C. rather than 900° C. The resistivity of the resulting carrier is determined by substantially the same procedure, and is measured to be $1.5\times10^8$ ohm-cm, i.e., it is slightly more resistive relative to the carrier fired at 900° C. used in Example 43, which is consistent with the general results obtained by Examples 11–13 hereinabove as shown in FIG. 4. The toner is substantially similar to that employed in Example 43, except that it is ground and classified to yield a toner powder with an average particle size of 9.9 μm as determined using a COULTER COUNTER® device. The five developer compositions are made by substantially the same procedure, except that the amount of toner employed is sufficient to yield a TC of 5.1, 6.9, 9.1, 11.0, and 12.9 wt % respectively, based on the total weight of the applicable developer composition. The data obtained is shown in Table XVII below:

TABLE XVII

Example 44 - Data For Carrier with 1.0 pph $SnO_2$ Coating (875° C.), Toner (9.9 μm), and Varying TC Level

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 9.9 | 5.1 | −62.9 | 3.4 | 0.469 | 1.91 | 0.0277 | $6.10\times10^{-3}$ | $4.7\times10^7$ |
| 2 | 9.9 | 6.9 | −47.5 | 3.5 | 0.638 | 2.59 | 0.0051 | $1.12\times10^{-4}$ | $8.4\times10^7$ |
| 3 | 9.9 | 9.1 | −41.4 | 4.1 | 0.709 | 2.88 | 0.0027 | $6.00\times10^{-5}$ | $1.5\times10^8$ |
| 4 | 9.9 | 11.0 | −36.2 | 4.5 | 0.702 | 2.85 | 0.0024 | $5.30\times10^{-5}$ | $2.6\times10^8$ |
| 5 | 9.9 | 12.9 | −32.3 | 4.8 | 0.652 | 2.65 | 0.0011 | $2.40\times10^{-5}$ | $3.6\times10^8$ |

*Relative to the control carrier as described in Example 43 above.

[1]$(Q/m)_{toner}$

[2]$(Q/m)_{carrier}$

The results are consistent with Example 43. The data in Table XVII illustrates that by varying TC level in the developer composition, for example at a toner average particle size of about 10 μm, one can vary the toner concentration in the developer from about 5 to 13 wt %, based on total weight of the developer, and thereby TC adjust the $(Q/m)_{carrier}$ value for the developer composition and directly influence the I-CPU characteristic. The data suggest that I-CPU can be modulated by the $(Q/m)_{carrier}$ value.

EXAMPLE 45

In Example 45, the procedures described in Example 43 above are substantially repeated except as provided hereinafter. The carrier employed is the 1.0 pph $SnO_2$ coated carrier prepared as described in Example 43. The toner employed is a yellow polyester toner prepared substantially as described in U.S. Pat. No. 4,833,060, as described in Examples 1–4 hereinabove. The toner is also surface-treated with 0.89 wt % (based on total weight of the toner) of silica (AEROSIL® R972, from Degussa-Hüls AG, Frankfurt am Main, Germany) to enhance toner flow properties. The surface treatment is performed by powder blending the pulverized and classified toner particles with the AEROSIL® R972 silica, in a high-energy Henschel FM75 mixer from Thyssen Henschel Industrietechnik GmbH, Kassel, Germany. The toner and the AEROSIL® R972 silica are added to the mixer in amounts sufficient to yield the above-described weight percentage of silica, and thereafter the mixer is operated at a speed of 1745 revolutions per minute (rpm) for 2.5 minutes. Subsequently, the resulting toner/silica mixture is collected and sieved with a 325 mesh screen to remove agglomerated silica particles. The resulting sieved surface treated toner is then further employed to prepare developers as described hereinbelow. The toner has an average particle size of 7.1 μm as determined by a COULTER COUNTER® device. The five developer compositions are made by substantially the same procedure described in Example 43, except that the amount of toner employed is sufficient to yield a TC of 3.7, 4.8, 5.9, 6.3, and 8.0 wt % respectively, based on the total weight of the applicable developer composition. The data obtained is shown in Table XVIII below:

TABLE XVIII

Example 45 - Data For Carrier with 1.0 pph $SnO_2$ Coating (900° C.), Toner (7.1 μm), and Varying TC Level

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 7.1 | 3.7 | −62.3 | 2.4 | 0.482 | 1.96 | 0.0562 | $1.24\times10^{-3}$ | $1.2\times10^7$ |
| 2 | 7.1 | 4.8 | −65.0 | 3.3 | 0.473 | 1.92 | 0.0264 | $5.82\times10^{-4}$ | $1.5\times10^7$ |
| 3 | 7.1 | 5.9 | −66.9 | 4.2 | 0.404 | 1.64 | 0.0095 | $2.10\times10^{-4}$ | $1.9\times10^7$ |
| 4 | 7.1 | 6.3 | −66.7 | 4.5 | 0.494 | 2.01 | 0.0071 | $1.56\times10^{-4}$ | $1.9\times10^7$ |
| 5 | 7.1 | 8.0 | −75.7 | 6.6 | 0.584 | 2.37 | 0.0029 | $6.40\times10^{-5}$ | $4.5\times10^7$ |

*Relative to the control carrier as described in Example 43 above.

[1]$(Q/m)_{toner}$

[2]$(Q/m)_{carrier}$

The results in Table XVIII show the same relationship illustrated by Examples 43 and 44. The data in Table XVIII illustrates that by varying TC level in the developer composition, for example at a toner average particle size of about 7 μm, one can vary the toner concentration in the developer from about 4 to 8 wt %, based on total weight of the developer, and thereby TC adjust the $(Q/m)_{carrier}$ value for the developer composition and directly influence the I-CPU characteristic.

EXAMPLE 46

In Example 46, the procedures described in Example 43 above are substantially repeated except as provided hereinafter. The carrier employed is the 1.0 pph $SnO_2$ coated carrier prepared as described in Example 43. The toner employed is made from 100 parts of a polyester resin binder, 1 part of a di-tertbutyl salicylic acid charge-control agent (BONTRON E-88) and 4 parts carbon black (CABOT 330, from Cabot Corporation) and is prepared by conventional methods well-known in the art. The toner is ground and classified so as to have an average particle size of 5.9 μm as determined by a COULTER COUNTER® device. The toner is also surface treated with 1.5 wt % (based on total weight of the toner) of silica (AEROSIL® R972, from Degussa-H üls AG) to enhance flow properties by substantially the same procedure as described in Example 45.

TABLE XIX

Example 46 - Data For Carrier with 1.0 pph $SnO_2$ Coating (900° C.), Toner (5.9 μm), and Varying TC Level

| Run No. | Toner Size (μm) | TC (wt %) | $(Q/m)^1$ (μC/g) | $(Q/m)^2$ (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 5.9 | 3.8 | −67.2 | 2.7 | 0.386 | 1.57 | 0.0599 | $1.32 \times 10^{-3}$ | $9.6 \times 10^{6}$ |
| 2 | 5.9 | 4.8 | −72.8 | 3.6 | 0.339 | 1.38 | 0.0379 | $8.35 \times 10^{-4}$ | $1.2 \times 10^{7}$ |
| 3 | 5.9 | 5.6 | −69.4 | 4.1 | 0.387 | 1.57 | 0.0162 | $3.57 \times 10^{-4}$ | $1.5 \times 10^{7}$ |
| 4 | 5.9 | 6.7 | −73.5 | 5.3 | 0.398 | 1.62 | 0.0077 | $1.70 \times 10^{-4}$ | $2.0 \times 10^{7}$ |
| 5 | 5.9 | 7.7 | −73.2 | 6.1 | 0.424 | 1.72 | 0.0035 | $7.70 \times 10^{-5}$ | $2.6 \times 10^{7}$ |

*Relative to the control carrier as described in Example 43 above.

[1] $(Q/m)_{toner}$

[2] $(Q/m)_{carrier}$

The results in Table XIX show the same results illustrated by Examples 43–45. The data in Table XIX illustrates that by varying TC level in the developer composition, for example at a toner average particle size of about 6 μm, one can vary the toner concentration in the developer from about 4 to 8 wt %, based on total weight of the developer, and thereby TC adjust the $(Q/m)_{carrier}$ value for the developer composition and directly influence the I-CPU characteristic.

Further, it is seen that each data set (in other words, the data for the 12.2 μm toner, 9.9 μm toner, 7.1 μm toner and 5.9 μm toner, respectively) supports the discussion hereinabove in relation to FIG. 1. For each toner employed (with a specific average particle size), an operating window can be developed based on the developer resistivity and $(Q/m)_{carrier}$ that defines the relationship between development efficiency and I-CPU.

Figure 5:
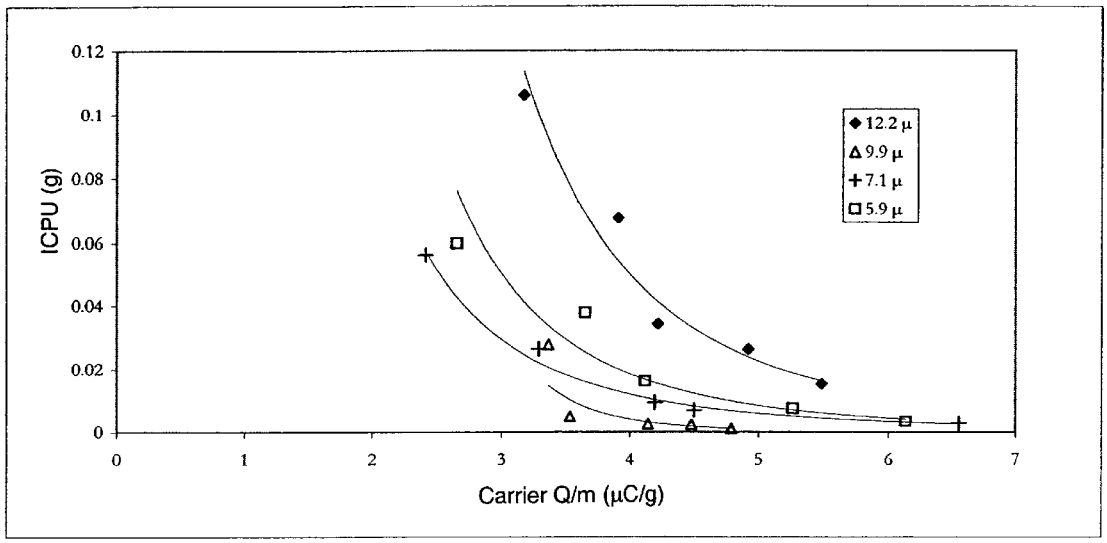
FIG. 5 is a graph of I-CPU (grams deposited) versus $(Q/m)_{carrier}$ data relating to Examples 43–46 and is discussed at the end of Example 46 hereinafter.

As shown by the data, adjusting the TC and maintaining the $(Q/m)_{carrier}$ parameter preferably above 1 μC/g, more preferably greater than 3.0 μC/g, and most preferably greater than 4.0 μC/g, can yield reduced amounts of deposition density for carrier in the resulting image. The relationship between I-CPU and $(Q/m)_{carrier}$ is illustrated by FIG. 5, which shows the data obtained for such parameters in Examples 43–46. Very low levels of I-CPU are generally obtained when the $(Q/m)_{carrier}$ parameter is greater than 2 μC/g, and especially at higher levels for the $(Q/m)_{carrier}$ parameter.

While not wishing to be bound by theory, it is believed that as the carrier enters into an area known as the "nip" between the photoconductive film and core (with developer thereon), the carrier on the core has a positive charge level determined by the TC and $(Q/m)_{toner}$ for the developer employed. In the nip, the carrier begins to charge negatively at a rate proportional to the toning bias and developer resistivity. I-CPU should be minimal provided the carrier charge in the nip area is maintained at a positive level. Thus, it is important to maintain the $(Q/m)_{carrier}$ at a positive level, particularly at the levels described above, so that the carrier does not reach a negative charge level in the nip area which can lead to I-CPU.

EXAMPLE 47

In Example 47, the procedures described in Examples 43–46 above are substantially repeated, except as provided hereinafter. The carrier employed is a 1.0 pph $SnO_2$ coated carrier prepared substantially as described in Example 43, except that it is fired at an oven temperature of 610° C. The carrier has a resistivity of $2.1 \times 10^{10}$ ohm-cm. The series of developers with varying TC levels is not provided, but developers are made using each of the four toners from Examples 43–46.

The toner employed in Run No. 1 is the black poly (styrene-co-butylacrylate) toner described in Example 43; the toner employed in Run No. 2 is the black poly(sytrene-co-butylacrylate) toner described in Example 44; the toner employed in Run No. 3 is the yellow polyester toner described in Example 45; and the toner employed in Run No. 4 is the black polyester toner described in Example 46. The four developer compositions (carrier and the toners as previously described) are made by substantially the same procedure described in Example 43. The TC employed in each developer composition is shown in Table XX, along with electrographic performance data:

TABLE XX

Example 47 - Data For Developers Made Using $SnO_2$ Coated Carrier (610° C.), and Different Particle Size Toners

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 12.2 | 10.2 | −23.2 | 2.6 | 0.504 | 2.05 | 0.0016 | $3.53 \times 10^{-5}$ | $2.2 \times 10^{12}$ |
| 2 | 9.9 | 9.0 | −39.8 | 3.9 | 0.348 | 1.41 | N.D. | N.D. | $2.1 \times 10^{12}$ |
| 3 | 7.1 | 6.0 | −45.3 | 2.9 | 0.246 | 1.00 | N.D. | N.D. | $1.2 \times 10^{12}$ |
| 4 | 5.9 | 5.8 | −49.2 | 3.0 | 0.261 | 1.06 | 0.0005 | $1.12 \times 10^{-5}$ | $8.7 \times 10^{11}$ |

*Relative to the control carrier as described in Example 43 above.
[1]$(Q/m)_{toner}$
[2]$(Q/m)_{carrier}$
N.D. - none detected

EXAMPLE 48

In Example 48, the procedure described in Example 47 above is substantially repeated, except as provided hereinafter. The carrier employed is a 1.0 pph $SnO_2$ coated carrier prepared substantially as described in Example 47, except that it is fired at an oven temperature of 825° C. The carrier has a resistivity of $8.0 \times 10^9$ ohm-cm. The TC employed in each developer composition is shown in Table XXI, along with electrographic performance data:

TABLE XXI

Example 48 - Data For Developers Made Using $SnO_2$ Coated Carrier (825° C.), and Different Particle Size Toners

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 12.2 | 9.8 | −30.0 | 3.2 | 0.652 | 2.65 | 0.0036 | $7.93 \times 10^{-5}$ | $3.1 \times 10^{10}$ |
| 2 | 9.9 | 9.0 | −40.2 | 4.0 | 0.426 | 1.73 | 0.0015 | $3.30 \times 10^{-5}$ | $7.8 \times 10^{10}$ |
| 3 | 7.1 | 5.8 | −52.6 | 3.2 | 0.383 | 1.56 | 0.0008 | $1.76 \times 10^{-5}$ | $1.1 \times 10^{10}$ |
| 4 | 5.9 | 5.9 | −56.3 | 3.5 | 0.283 | 1.15 | 0.0005 | $1.10 \times 10^{-4}$ | $3.7 \times 10^{9}$ |

*Relative to the control carrier as described in Example 43 above.
[1]$(Q/m)_{toner}$
[2]$(Q/m)_{carrier}$

EXAMPLE 49

In Example 49, the procedure described in Example 47 above is substantially repeated, except as provided hereinafter. The carrier employed is a 1.0 pph $GeO_2$ coated carrier prepared substantially as described in Examples 11–13, fired at an oven temperature of 750° C. The carrier has a resistivity of $5.2 \times 10^6$ ohm-cm. The TC employed in each developer composition is shown in Table XXII, along with electrographic performance data:

TABLE XXII

Example 49 - Data For Developers Made Using $GeO_2$ Coated Carrier (750° C.), and Different Particle Size Toners

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 12.2 | 10.1 | −18.7 | 2.1 | 0.858 | 3.49 | 0.0808 | $1.78 \times 10^{-3}$ | $2.4 \times 10^{6}$ |
| 2 | 9.9 | 8.9 | −28.0 | 2.7 | 0.700 | 2.85 | 0.0203 | $4.47 \times 10^{-4}$ | $1.7 \times 10^{6}$ |
| 3 | 7.1 | 5.8 | −49.7 | 3.1 | 0.564 | 2.29 | 0.0623 | $1.37 \times 10^{-3}$ | $8.3 \times 10^{5}$ |
| 4 | 5.9 | 5.7 | −59.9 | 3.6 | 0.545 | 2.22 | 0.0612 | $1.35 \times 10^{-3}$ | $9.4 \times 10^{5}$ |

*Relative to the control carrier as described in Example 43 above.
[1]$(Q/m)_{toner}$
[2]$(Q/m)_{carrier}$

EXAMPLE 50

In Example 50, the procedures described in Example 47 are substantially repeated except as provided hereinafter. The carrier employed is a strontium ferrite material doped with Lanthanum metal (Carrier FXC4809, from Powdertech International Corporation. The carrier has a resistivity of $2.8 \times 10^5$ ohm-cm. The series of developers with varying TC levels is not provided, but developers are made using each of the four toners from Examples 43–46.

The toner employed in Run No. 1 is the black poly (styrene-co-butylacrylate) toner described in Example 43; the toner employed in Run No. 2 is the black poly(sytrene-co-butylacrylate) toner described in Example 44; the toner employed in Run No. 3 is the yellow polyester toner described in Example 45; and the toner employed in Run No. 4 is the black polyester toner described in Example 46. The four developer compositions (carrier and the toners as previously described) are made by substantially the same procedure described in Example 43. The TC employed in each developer composition is shown in Table XXIII, along with electrographic performance data:

TABLE XXIII

Example 50 - Data For Developers Made Using Lanthanum Doped Carrier and Different Particle Size Toners

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 12.2 | 10.7 | −52.4 | 6.3 | 0.949 | 3.86 | 0.125 | $2.88 \times 10^{-3}$ | $4.4 \times 10^5$ |
| 2 | 9.9 | 9.3 | −44.7 | 4.6 | 0.829 | 3.37 | 0.0485 | $1.12 \times 10^{-3}$ | $3.1 \times 10^5$ |
| 3 | 7.1 | 5.5 | −101.6 | 5.9 | 0.674 | 2.74 | 0.0978 | $2.25 \times 10^{-3}$ | $1.5 \times 10^5$ |
| 4 | 5.9 | 5.3 | −151.9 | 8.5 | 0.639 | 2.60 | 0.0890 | $2.05 \times 10^{-3}$ | $1.6 \times 10^5$ |

*Relative to the control carrier as described in Example 43 above.
[1]$(Q/m)_{toner}$
[2]$(Q/m)_{carrier}$

Comparative Example E

In Comparative Example E, the procedure described in Example 47 above is substantially repeated, except as provided hereinafter. The carrier employed is a conventional carrier substantially as described in Comparative Example A, except that it has a resistivity of $8\times10^{10}$ ohm-cm. The TC employed in each developer composition is shown in Table XXIV, along with electrographic performance data:

TABLE XXIV

Comparative Example E - Data For Developers Made With Conventional Hard Ferrite Carrier, and Different Particle Size Toners

| Run No. | Toner Size (μm) | TC (wt %) | (Q/m)[1] (μC/g) | (Q/m)[2] (μC/g) | DE | Rel DE* | I-CPU (grams) | I-CPU (g/in$^2$) | Dev. Resistivity (Ohm-cm) |
|---|---|---|---|---|---|---|---|---|---|
| 1 | 12.2 | 10.1 | −60.5 | 6.8 | 0.408 | 1.66 | 0.0019 | $4.19 \times 10^{-5}$ | $2.6 \times 10^{12}$ |
| 2 | 9.9 | 8.7 | −53.6 | 5.1 | 0.369 | 1.50 | 0.0005 | $1.10 \times 10^{-5}$ | $3.4 \times 10^{12}$ |
| 3 | 7.1 | 5.2 | −104.8 | 5.8 | 0.267 | 1.09 | 0.0002 | $4.40 \times 10^{-6}$ | $1.7 \times 10^{12}$ |
| 4 | 5.9 | 5.9 | −122.9 | 7.7 | 0.182 | 0.74 | 0.0002 | $4.40 \times 10^{-6}$ | $1.5 \times 10^{12}$ |

*Relative to the control carrier as described in Example 43 above.
[1](Q/m) toner
[2](Q/m) carrier

EXAMPLE 51

In Example 51, the procedure described in Example 44 above is substantially repeated except as provided hereinafter. The commercially-available $SrFe_{12}O_{19}$ hard ferrite carrier is coated with a $SnO_2$ coating by substantially following the procedures of Examples 41 and 43, i.e., the carrier is fired at an oven temperature of 900° C. rather than 875° C. The resistivity of the resulting carrier is $8\times10^7$ ohm-cm. A series of developers is not provided, but the toner (9.9 μm) described in Example 44 is used with the above-described carrier to make a single developer composition with a TC of 8.9 wt % based on the total weight of the developer composition. The data obtained is a $Q/m_{toner}$ of −42.1 μC/g; a $Q/m_{carrier}$ of 4.1 μC/g; a DE of 0.645, a Rel DE of 2.62 (compared to the control carrier of Example 47, Run 3), Developer Resistivity of $4.7\times10^7$ Ohm-cm, and a I-CPU of 0.005 gram (and in terms of deposition density $1.10\times10^{-4}$ g/in$^2$).

EXAMPLE 52

In Example 52, the procedure described in Example 51 above is substantially repeated except as provided hereinafter. The commercially-available $SrFe_{12}O_{19}$ hard ferrite carrier is coated with a $SnO_2$ coating by substantially following the procedures of Examples 41 and 43, except that the carrier is fired at an oven temperature of 1025° C. rather than 900° C. The resistivity of the resulting carrier is $7.7\times10^5$ ohm-cm. A series of developers is not provided, but the toner (9.9 μm) described in Example 44 is used with the above-described carrier to make a single developer composition with a TC of 9.0 wt % based on the total weight of the developer composition. The data obtained is $Q/m_{toner}$ of −43.1 μC/g; $Q/m_{carrier}$ of 4.2 μC/g; DE of 0.832, Rel DE of 3.38 (compared to the control carrier of Example 47, Run 3), Developer Resistivity of $5.0\times10^5$ Ohm-cm, and a I-CPU of 0.0578 gram (and in terms of deposition density $1.27\times10^{-3}$ g/in$^2$).

Figure 6:
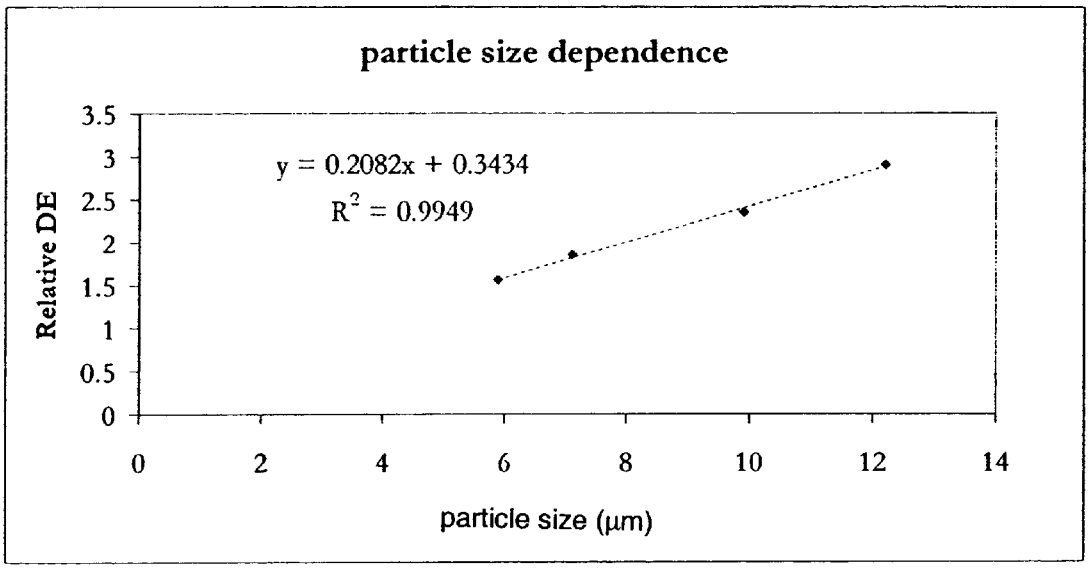
FIG. 6 is a graph of Mean Relative DE data versus toner particle size relating to Examples 43–52 and is discussed at the end of Example 52 hereinafter.
Figure 7:
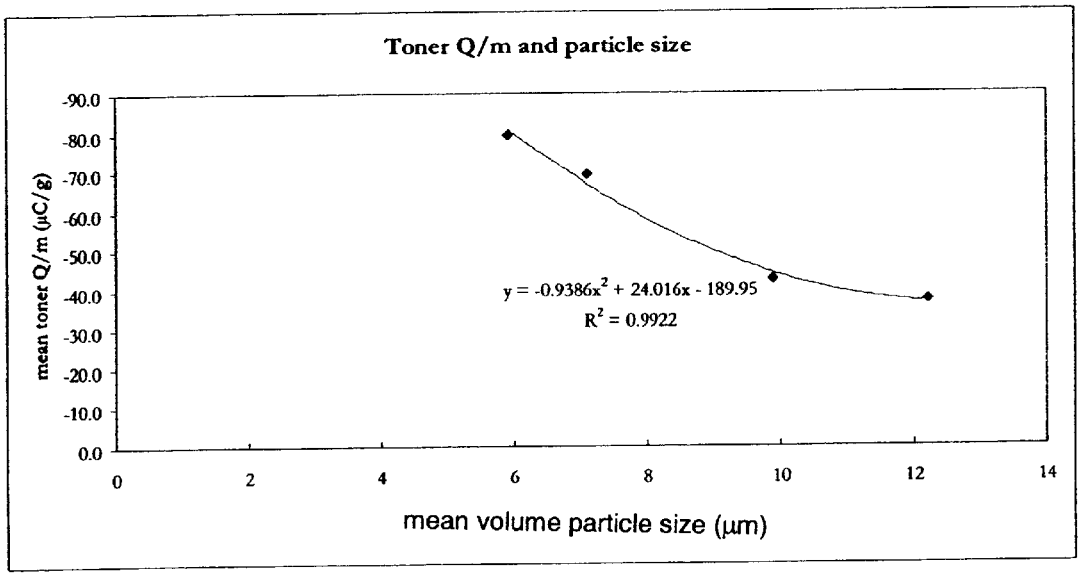
FIG. 7 is a graph of Mean $(Q/m)_{toner}$ data versus toner particle size relating to Examples 43–52 and is discussed at the end of Example 52 hereinafter.

The relationship of the data obtained by Examples 43–52 and Comparative Example E for Relative Development Efficiency (based on an average of the Rel DE data obtained for each toner particle size) versus toner particle size is shown in FIG. 6, while the data for $(Q/m)_{toner}$ (based on an average of the $(Q/m)_{toner}$ data obtained at each toner particle size) versus toner particle size is shown in FIG. 7. As can be seen, this data shows the impact of particle size on development efficiency and general relationship of average toner particle size and $(Q/m)_{carrier}$.

Figure 8:
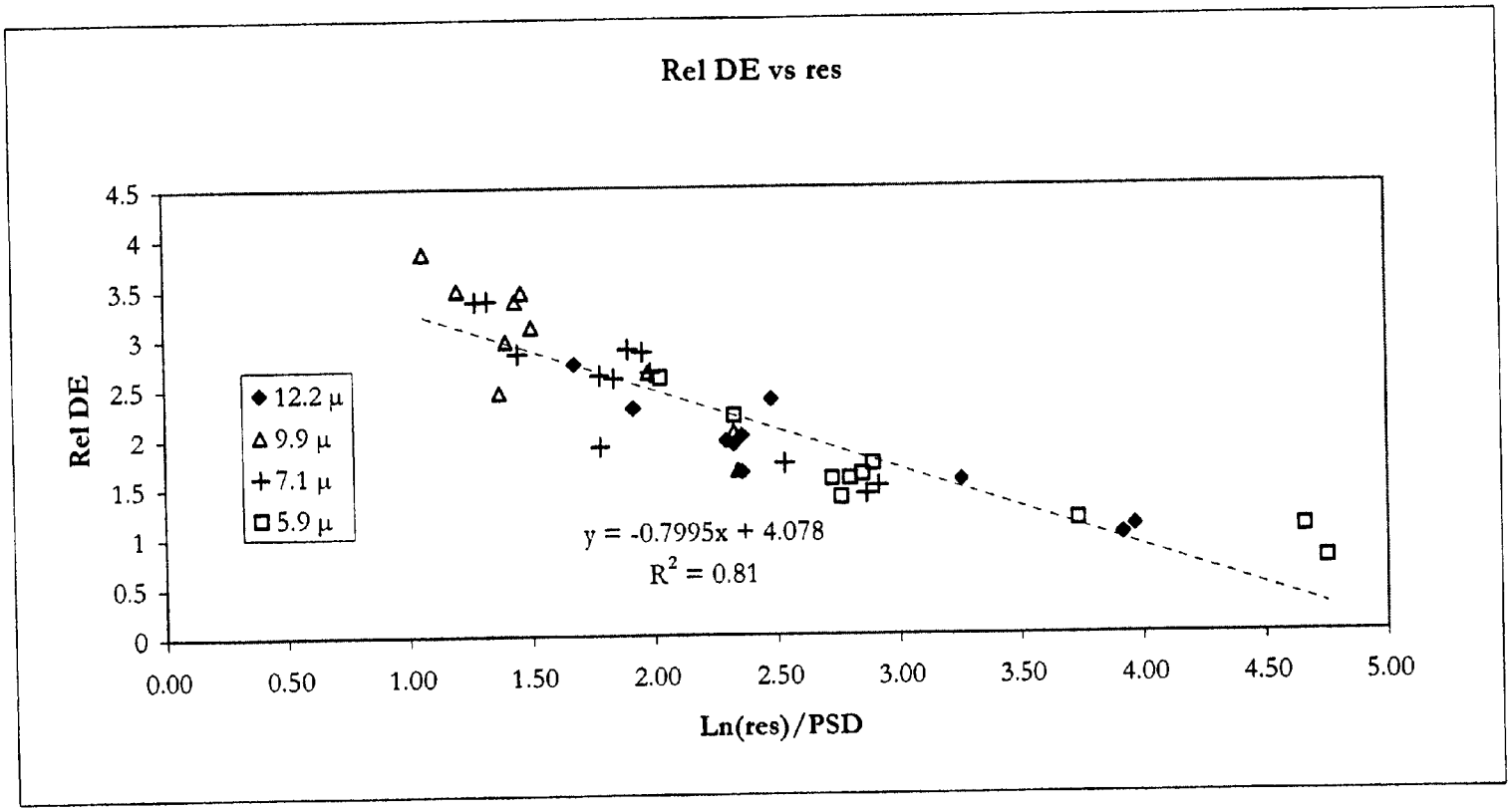
FIG. 8 is a graph of Relative DE data versus $Log_e$ of (carrier resistivity/toner particle size) relating to Examples 43–52 and is discussed at the end of Example 52 hereinafter.

The data obtained by Examples 43–52 and Comparative Example E also show that development efficiency is directly related to carrier resistivity normalized to the particle size of the toner employed. This relationship is shown in FIG. 8.

Figure 9:
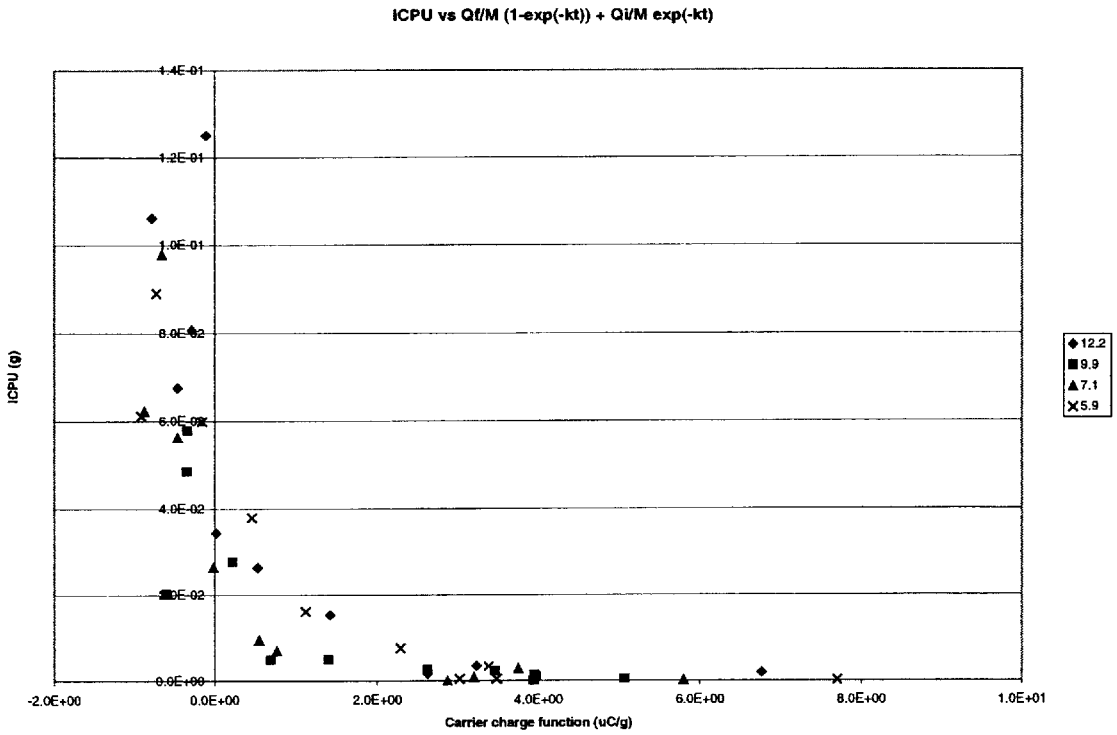
FIG. 9 is a graph of I-CPU (weight in grams) versus a function representing acquired carrier charge (in terms of $\mu$C/g) relating to Examples 43–52 and Comparative Example E, and is discussed at the end of Example 52 hereinafter.

The data obtained by Examples 43–52 and Comparative Example E also clearly shows that I-CPU depends on the charge that the carrier acquires in the toning nip area. Using the data from these examples, $Q_{Ct}/M_C$ is calculated from Equation (3) described hereinabove in the Detailed Description section and the observed ICPU values are then plotted versus the calculated $Q_{Ct}/M_C$. The resulting graph, FIG. 9, is generated using measured data for TC, $Q_T/M_T$ in units of $\mu$C/g, p in units of ohm-cm, and DE. The limiting value of $Q_{Ct}/M_C$ used is assumed to be approximately −2 $\mu$C./g, t is approximately 0.075 sec=nip width of 0.375 inches divided by a 5 inches/sec process speed, and $1/\epsilon=8\times10^{17}$ ohm/(sec cm$^2$)$\times D_T^3$, with $D_T$(toner average particle diameter) measured in centimeters (cm). The constants of −2 $\mu$C/g and $8\times10^{17}$ ohm/(sec cm$^2$) contain the adjustable parameters in this model. FIG. 9 shows that I-CPU depends on the charge that the carrier acquires in the toning nip area, and that there is a threshold value for $Q_{Ct}/M_C$ below which I-CPU would acceptable.

Carriers and developer compositions comprised of barium and lead containing ferrites, commonly referred to as magnetoplumbite ferrites, with characteristics as described hereinabove are expected to achieve similar results when used as electrographic carrier materials.

"Electrography" and "electrographic" as used herein are broad terms that include image forming processes involving the development of an electrostatic charge pattern formed on a surface with or without light exposure, and thus includes electrophotography and other similar processes.

Although the invention has been described in considerable detail, and with particular reference to preferred embodiments, it should be understood that variations and modifications to such embodiments can be made within the scope of the invention.

What is claimed is:

1. A method for development of an electrostatic image comprising contacting the image with at least one magnetic brush comprising (a) a rotating magnetic core of a preselected magnetic field strength, (b) an outer nonmagnetic shell disposed about the rotating core, and (c) an electrographic developer composition disposed on the shell and in contact with the image, the developer composition comprising charged toner particles and oppositely charged carrier particles, the carrier particles comprising a hard magnetic material having a crystal structure substituted with at least one multi-valent metal of the formula $M^{n+}$, wherein n is an integer of at least 4.

2. The method of claim 1 wherein the hard magnetic material has a single-phase hexagonal crystal structure.

3. The method of claim 1 wherein the hard magnetic material is strontium ferrite or barium ferrite.

4. The method of claim 1 wherein n is 4 or 5.

5. The method of claim 1 wherein n is 4.

6. The method of claim 1 wherein the at least one multi-valent metal is selected from the group consisting of antimony, arsenic, germanium, hafnium, molybdenum, niobium, silicon, tantalum, tellurium, tin, titanium, tungsten, vanadium, zirconium, and mixtures thereof.

7. The method of claim 1 wherein the at least one multi-valent metal is selected from the group consisting of silicon, zirconium, tin, titanium, and mixtures thereof.

8. The method of claim 1 wherein the carrier particles comprise a hard magnetic ferrite material having a single-phase hexagonal crystal structure represented by the formula:

$$PFe_{12-x}M_xO_{19}$$

wherein:

P is selected from strontium, barium, or lead;

M is at least one metal selected from antimony, arsenic, germanium, hafnium, molybdenum, niobium, silicon, tantalum, tellurium, tin, titanium, tungsten, vanadium, zirconium, and mixtures thereof; and x is less than about 0.6.

9. The method of claim 8 wherein P is strontium.

10. The method of claim 8 wherein x is less than about 0.2.

11. The method of claim 8 wherein the at least one metal is selected from the group consisting of silicon, zirconium, tin, titanium, and mixtures thereof.

12. The method of claim 8 wherein the carrier particles are surface coated with a resin layer.

13. The method of claim 12 wherein the layer is discontinuous.

14. The method of claim 12 wherein the resin is a mixture of polyvinylidene fluoride and polymethylmethacrylate.

15. The method of claim 12 wherein the resin is a silicone resin.

16. The method of claim 8 wherein said magnetic material is strontium or barium ferrite.

17. A method for development of an electrostatic image comprising contacting the image with at least one magnetic brush comprising (a) a rotating magnetic core of a preselected magnetic field strength, (b) an outer nonmagnetic shell disposed about the rotating core, and (c) an electrographic developer composition disposed on the shell and in contact with the image, the developer composition comprising charged toner particles and oppositely charged carrier particles, the carrier particles comprising (1) a core of a hard magnetic material having an outer surface (2) of a metal oxide coating disposed on the outer surface of the core represented by the formula $MO_{n/2}$ wherein M is at least one multi-valent metal represented by $M^{n+}$, with n being an integer of at least 4, the outer surface further defining a transition zone which extends from the outer surface and into the core of the hard magnetic material where the crystal structure within the transition zone is substituted with ions of the at least one multi-valent metal ion of formula $M^{n+}$, and the metal oxide coating further comprising an alkali metal oxide.

18. The method of claim 17 wherein the alkali metal is selected from the group consisting of lithium, potassium, and sodium.

19. A method for development of an electrostatic image comprising contacting the image with at least one magnetic brush comprising (a) a rotating magnetic core of a preselected magnetic field strength, (b) an outer nonmagnetic shell disposed about the rotating core, and (c) an electrographic developer composition disposed on the shell and in contact with the image, the developer composition comprising charged toner particles and oppositely charged carrier particles, the carrier particles comprising (1) a core of a hard magnetic material having an outer surface (2) of a metal oxide coating disposed on the outer surface of the core represented by the formula $MO_{n/2}$ wherein M is at least one multi-valent metal represented by $M^{n+}$, with n being an integer of at least 4, the outer surface further defining a transition zone which extends from the outer surface and into the core of the hard magnetic material where the crystal structure within the transition zone is substituted with ions of the at least one multi-valent metal ion of formula $M^{n+}$, the carrier particles further comprising a resin layer of at least one polymer resin disposed on the metal oxide coating.

20. The method of claim 19 wherein the resin layer is discontinuous.

21. The method of claim 19 wherein the at least one polymer resin is a mixture of polyvinylidene fluoride and polymethylmethacrylate.

22. The method of claim 19 wherein the at least one polymer resin is a silicone resin.

23. A method for development of an electrostatic image comprising contacting the image with at least one magnetic brush comprising (a) a rotating magnetic core of a preselected magnetic field strength, (b) an outer nonmagnetic shell disposed about the rotating core, and (c) an electrographic developer composition disposed on the shell and in contact with the image, the developer composition comprising charged toner particles and oppositely charged carrier particles, the carrier particles comprising (1) a core of a hard magnetic material having an outer surface (2) of a metal oxide coating disposed on the outer surface of the core represented by the formula $MO_{n/2}$ wherein M is at least one multi-valent metal represented by $M^{n+}$, with n being an integer of at least 4, the outer surface further defining a transition zone which extends from the outer surface and into the core of the hard magnetic material where the crystal structure within the transition zone is substituted with ions of the at least one multi-valent metal ion of formula $M^{n+}$;

wherein the metal oxide coating is selected from the group consisting of germanium oxide, zirconium oxide, titanium oxide, tin oxide, and mixtures thereof; and wherein the metal oxide coating further comprises a second metal oxide selected from the group consisting of boron oxide, lithium oxide, and sodium oxide.

24. A method for development of an electrostatic image comprising contacting the image with at least one magnetic brush comprising (a) a rotating magnetic core of a preselected magnetic field strength, (b) an outer nonmagnetic shell disposed about the rotating core, and (c) an electrographic developer composition disposed on the shell and in contact with the image, the developer composition comprising charged toner particles and oppositely charged carrier particles, the carrier particles comprising a hard magnetic ferrite material having a single-phase hexagonal crystal structure represented by the formula:

$$P_{1-y}La_yFe_{12}O_{19}$$

wherein:

P is selected from strontium, barium, or lead; and y is less than or equal to 0.05.

* * * * *